US005628086A

United States Patent [19]

Knowlton et al.

[11] Patent Number: 5,628,086

[45] Date of Patent: *May 13, 1997

[54] FLOOR CLEANING APPARATUS WITH SQUEEGEE MOUNTING SYSTEM

[75] Inventors: Christopher M. Knowlton, Pinehurst, N.C.; Robert J. O'Hara, Castle Rock, Colo.

[73] Assignee: Windsor Industries, Inc., Englewood, Colo.

[ * ] Notice: The term of this patent shall not extend beyond the expiration date of Pat. No. 5,485,653.

[21] Appl. No.: 455,308

[22] Filed: May 31, 1995

Related U.S. Application Data

[63] Continuation of Ser. No. 233,014, Apr. 25, 1994, Pat. No. 5,485,653.

[51] Int. Cl.[6] ..... A47L 11/30

[52] U.S. Cl. ..... 15/340.1; 15/401; 15/245

[58] Field of Search ..... 15/245, 401, 320, 15/340.1, 340.2, 340.3, 340.4

[56] References Cited

U.S. PATENT DOCUMENTS

| | | | |
|---|---|---|---|
| 4,611,363 | 9/1986 | Samuelsson | 15/245 |
| 5,184,372 | 2/1993 | Mache | 15/401 |
| 5,239,720 | 8/1993 | Wood et al. | 15/407 |
| 5,349,718 | 9/1994 | Gibbon | 15/250.36 |
| 5,377,382 | 1/1995 | Bores et al. | 15/245 |

FOREIGN PATENT DOCUMENTS

| | | | |
|---|---|---|---|
| 0226251 | 1/1960 | Australia | 15/245 |

OTHER PUBLICATIONS

Tennant Model 1465 and 1480 Manual, pp. 3–18 and 6–34, 1988, U.S.

*Primary Examiner*—Reginald Alexander
*Attorney, Agent, or Firm*—Sheridan Ross PC

[57] ABSTRACT

The present invention provides an apparatus for cleaning floors. In one embodiment, the apparatus includes four wheels, two of which are steerable wheels, and a steering mechanism that permits the two steerable wheels to turn to a degree that allows very tight turns to be made by the sweeper. In another embodiment, the apparatus is a sweeper with a cylindrical side broom. Yet a further embodiment of the sweeper includes flaps or seals that form a skirt about the broom and a mounting mechanism for slidably receiving the flap or seal. In a further embodiment, the apparatus is a sweeper that employs flaps with wear indicators that tell an operator when to adjust or replace the flap. In another embodiment, the apparatus is a sweeper that utilizes a pre-filter to remove debris that remains in the vacuum airstream after having passed through the hopper and that is of a size that can require frequent cleaning of a subsequent filtering device. In yet a further embodiment, the apparatus is a scrubber with two counter rotating disk brushes, a primary squeegee, and a second or pre-squeegee for relieving the primary squeegee from processing the heavier concentration of wastewater produced in the area between the brushes. In yet another embodiment, the apparatus is a scrubber that includes a squeegee mounting systems that is relatively easy to use and permits the squeegee rubber to extend beyond the end of the mounting structure.

22 Claims, 24 Drawing Sheets

FLOOR CLEANING APPARATUS WITH SQUEEGEE MOUNTING SYSTEM

This is a continuation of application Ser. No. 08/233,014, filed Apr. 25, 1994 now U.S. Pat. No. 5,485,653.

FIELD OF THE INVENTION

The present invention relates to cleaning apparatuses and, in particular, to sweepers and scrubbers that are used to clean floors.

BACKGROUND OF THE INVENTION

The typical industrial sweeper is a motor driven vehicle that employs a rotating broom to lift debris from a surface such as a floor. The sweeper also typically includes a vacuum system that establishes a directional airstream adjacent to the broom to pull the debris that has been lifted by the broom into a hopper where the heavier debris precipitates out of the airstream. The lighter debris is generally removed from the airstream by a filtering device.

Presently, most, if not all, industrial sweepers for cleaning floor surfaces and many street and municipal sweepers employ three-wheel drive/steering systems that provide the tight or short radius turning capability required by most sweeping applications. The three-wheel drive/steering systems are generally configured in a reverse tricycle arrangement that has two front non-steerable wheels and a single steerable, rear wheel. Generally, the two front wheels are the drive wheels but some sweepers drive the rear wheel. One problem with three-wheel sweepers is that the load supported by each of the wheels is, in many instances, so great that such sweepers can damage certain floors, like astroturf and tile. Three-wheel sweepers are also relatively unstable on uneven floors and therefore tend to tip, which can damage the sweeper, possibly injure the operator, and generally cause down time. Based on the foregoing, there is a need for a sweeper that addresses the aforementioned deficiencies of three-wheel sweepers while still providing the tight or short radius turning capability required in most sweeper applications.

Present sweepers also primarily rely upon a cylindrical broom, which rotates about an axis that is parallel to the floor surface, to lift debris for later deposit in the hopper. The cylindrical broom is generally located between the front and rear wheels and laterally extends no further than the edge of the sweeper body. Consequently, it is difficult, if not impossible, for the cylindrical broom to sweep the floor surface adjacent to walls and the like. Consequently, many sweepers employ a disk side broom that rotates about a vertical axis relative to the floor surface to move the debris adjacent to the wall into the path of the cylindrical broom so that debris can be picked up by the cylindrical broom and deposited in the hopper. The use of a disk side broom presents several problems. Namely, the disk side broom leaves a dusty path that is unacceptable in many applications. Moreover, the disk side broom only marginally increases the sweeping path of the sweeper. Based on the foregoing, there is a need for a sweeper that addresses the aforementioned deficiencies involved with using a disk side broom.

As previously mentioned, presently known sweepers typically employ a cylindrical broom to lift debris from the floor surface. The cylindrical broom is located in a housing structure situated between the front and rear wheels. The housing structure typically includes one or more flaps or seals that surround the broom to form a skirt with a lower edge that contacts the floor surface. The flaps or seals are generally flexible or hinged so that debris can enter the chamber and be swept up by the broom. The flaps or seals also prevent the debris that is being swept up by the broom from being thrown out from under the sweeper. Generally, the flaps or seals are bolted to a housing that surrounds the upper portion of the broom, the body, or the frame of the sweeper. Due to this bolted attachment, replacement of the flaps or seals is difficult and time consuming. Moreover, it is generally difficult to tell when a flap or seal is about to wear out or has worn out and no longer serving the aforementioned purposes. Consequently, there is a need for a flap system that can be used on sweepers to address the aforementioned problems.

As previously mentioned, the typical sweeper includes a broom that lifts debris, a vacuum to establish a directional airstream that pulls the lifted debris into the hopper where the heavy debris in the airstream precipitates out, and a filter for removing the lighter debris that remains in the airstream after passing through the hopper. Many applications involve sweeping floor surfaces of relatively fine particulate matter, such as the flour in a flour mill. In such applications, little of the particulate matter precipitates out of the airstream into the hopper. As a consequence, in such applications, the filter portion of the sweeper bears the load of removing the fine particulate matter from the airstream. As a result, in such applications, the filter tends to require frequent cleaning that increases the downtime of the sweeper and, in extreme cases, may require such frequent cleaning that the use of the sweeper becomes impractical. Consequently, there is a need for a sweeper that addresses the filter problem associated with presently known sweepers.

Another floor cleaning apparatus is a scrubber that mechanically scrubs a floor with a cleaning solution and then removes the cleaning solution from the floor. One type of scrubber is a motor driven vehicle that includes a device for spraying the floor surface with a soap or other cleaning solution, a pair of counter-rotating disk brushes for scrubbing the floor with the cleaning solution and producing a stream of wastewater in which the dirt is entrained, and a vacuum squeegee that is located behind the brushes and used to collect the wastewater for recycling. One problem with such scrubbers is that, due to the counter rotation of the disk brushes, a heavier concentration of wastewater is produced between the disk brushes and a relatively light concentration of wastewater is produced to the sides of the disk brushes. This difference in concentration can overwhelm the vacuum squeegee's ability to remove the wastewater from the floor and, as a consequence, the vacuum squeegee may leave a substantial amount of the wastewater on the floor. A further problem associated with scrubbers in general is that if solid or large debris is in the wastewater stream produced by the scrubbing brush or brushes, the vacuum squeegee may not be able to pick up the debris. In this case, the solid or large debris may cause the vacuum squeegee to leave streaks of wastewater that are discernable after the floor dries. Based on the foregoing, there is a need for a scrubber that addresses the aforementioned deficiencies with presently known scrubbers.

As previously mentioned, industrial scrubbers typically employ a vacuum squeegee for collecting wastewater for disposal or recycling. The typical vacuum squeegee includes a mount with a front edge for receiving a front squeegee rubber that has a lower edge which is disposed slightly above the floor so that water can pass thereunder, a back edge for receiving a rear squeegee that has a lower edge that contacts or seals against the floor, and a vacuum port located between the front and back edges for removing the wastewater trapped between the front and rear squeegee rubbers. Typically, the mount is curved to direct the wastewater towards the vacuum port. Operation of the typical vacuum squeegee commences with wastewater passing under the front squeegee and then being retained between the front and rear squeegees, where it is vacuumed up through the vacuum port. One problem with the typical vacuum squeegee is that the rear squeegee rubber, since it seals or drags against the floor, tends to wear out and require replacement. Presently known systems for attaching the rear squeegee rubber to a mounting structure are quite awkward and time consuming. Moreover, such mounting systems prevent the squeegee rubber from extending past the end of the mount and, as a consequence, make it difficult to run the squeegee rubber against a wall or similar structure.

SUMMARY OF THE INVENTION

The present invention provides an apparatus for cleaning a floor that uses four wheels to spread the load over the floor while also providing a relatively tight turning radius. Using four wheels, rather than three wheels, reduces the load applied to the floor surface, and as a consequence, permits floor surfaces, such as astroturf and tile, that may be damaged by a three wheel apparatus to be cleaned. The four wheels of the apparatus include two non-steerable wheels and two steerable wheels. The apparatus also includes a steering mechanism for turning the two steerable wheels to achieve a very tight turning radius. In one embodiment, the steering mechanism employs a pair of Pitman arms, a pair of rotatable arms, one associated with each of the steerable wheels, a first link between one of the Pitman arms and one of the rotatable arms, a second link between the other of the Pitman arms and the other of the rotatable arms, and a third link between the two Pitman arms. By appropriately positioning the Pitman arms, the angle through which the wheels can be turned by a rotation of one or the other of the Pitman arms can be adjusted. In one embodiment, the angle through which at least one of the two steerable wheels can be turned is greater than approximately 45°, which permits the apparatus to make very tight radius turns. In certain embodiments, the angle through which at least one of the two steerable wheels can be turned is greater than about 75° and greater than about 90°. In another embodiment of the apparatus, a floating suspension is employed with the two steerable wheels to facilitate travel of the apparatus over uneven surfaces.

The present invention also provides a sweeper for cleaning a floor that addresses the deficiencies associated with the disk side brushes used in the presently known sweepers. The sweeper includes a broom, typically a cylindrical broom, located in an area between the wheels or bounded by the exterior body surface of the sweeper. The sweeper further includes a cylindrical side broom that is located outside of the noted area and so that the area to the side of the body of the sweeper can be swept. The cylindrical side broom produces a polished floor surface that is superior to the relatively dusty appearance produced when a disk side broom is utilized. Moreover, the cylindrical side broom can be of a length that increases the sweeping path of the sweeper relative to presently known sweepers that employ a disk side brush. Various embodiments of the sweeper include a device that permits moving the cylindrical side brush between a stowed location away from the floor and an operable location adjacent to the floor. In another embodiment, a device is provided that permits the brush to be positioned to the right or left sides of the sweeper. In yet another embodiment, a device is included that permits the brush to rotate about a vertical axis between the ends of the brush so that if an obstacle is encountered during sweeping, the brush can rotate in a manner that reduces the possibility of breaking the cylindrical side brush mechanism.

The present invention also provides a flap or seal mounting system for use in sweepers that permits the flap to be easily mounted and demounted from the sweeper. The system includes a flap with a lower edge that, when the flap is attached to the sweeper, is positioned adjacent to the floor. The flap also includes an upper edge that is thicker than the lower edge and, when the flap is attached to the sweeper, is spaced from the floor. The system also includes a mounting structure that is attached to the sweeper and includes a slot with a broader upper portion and a narrower lower portion. The flap can be slidably inserted into the slot such that its thicker upper edge fits in the broader upper portion of the slot and a portion of the narrower lower edge fits in the narrower lower portion of the slot. Conversely, the flap can also be slidably removed from the slot in a relatively easy and speedy manner.

The present invention also provides a flap or seal for use with a sweeper that includes a wear indicator for use in informing an operator when the flap or seal needs to be replaced or adjusted. The flap includes a lower edge that, when the flap is attached to the sweeper, is positioned adjacent to the floor surface. The flap also includes an upper edge that is separated from the floor surface when the flap is attached to the sweeper. Located in between the upper and lower edges and at least initially spaced from the lower edge by a predetermined distance is a wear indicator. In one embodiment the wear indicator includes a bulb that runs the length of the flap and is substantially parallel to the upper and lower edges. The bulb can be a different color from the adjacent flap material or can be made from a different material from the adjacent flap material. In another embodiment, a plurality of wear indicators can be established between the upper and lower edges of the flap. This embodiment is especially useful if the position of the flap can be adjusted. Specifically, as one wear indicator is reached, the flap can be adjusted downward and as other wear indicators are reached, the adjustment process can be repeated until the last wear indicator is reached, indicating that the flap needs to be replaced. In yet a further embodiment, the flap includes a plurality of wear indicators, the thicker upper edge and thinner lower edge previously mentioned. This embodiment of the flap can be used with a mounting structure that includes a plurality of the mounting slots previously mentioned. In operation, the flap is initially inserted into the uppermost slot of the mounting structure and as wear indicators are attained, the flap is moved down a slot at a time.

The present invention also provides a sweeper with a vacuum system that utilizes a pre-filter to reduce the need to clean or otherwise service a subsequent filter. The pre-filter is particularly useful in environments where relatively small particulate matter is prevalent. In one embodiment, the vacuum system includes a broom for lifting debris from the floor surface, a vacuum source for establishing a directional airstream to pull the debris lifted by the broom along a collection path, a hopper for initially receiving the debris laden airstream and collecting heavier debris therefrom, a pre-filter for receiving the airstream after it passes through the hopper and removing the less heavier debris that was not removed from the airstream by the hopper, and a filter for removing even less heavier debris from the airstream that was not collected by the hopper or the pre-filter. In one embodiment, the pre-filter includes a vane structure for creating a vortex that is useful in separating out the less heavier debris. In another embodiment, the pre-filter includes a vaned wheel that is used to direct the less heavier debris to a collection point.

The present invention also provides a scrubber with a scrubbing/squeegee system that utilizes a secondary or pre-squeegee to relieve a primary squeegee from processing the heavier concentration of wastewater produced between a pair of counter-rotating disk scrub brushes. More specifically, the scrubbing/squeegee system includes a pair of disk scrub brushes that are positioned adjacent to one another and rotate in opposite directions. Due to the counter rotation of the brushes, a heavier concentration of wastewater is produced between the brushes than to the sides of the brushes. The scrubbing/squeegee system also includes a primary squeegee that is positioned behind the disk scrub brushes to collect the wastewater produced by the brushes. The system further includes a secondary or pre-squeegee located between the primary squeegee and the disk brushes to collect at least a portion of the heavier concentration of wastewater produced in the area between the two brushes and thereby relieve some of the load on the primary squeegee. As a result, the system removes more wastewater from the floor than presently known scrubbers. In one embodiment, the secondary or pre-squeegee is shorter than the primary squeegee and preferably extends for a length that is substantially equal to the distance between the vertical axes of the disk brushes. In another embodiment, the secondary or pre-squeegee includes a trap that collects solid or large debris from the wastewater which, if left to the primary squeegee, generally results in streaking of the floor. In yet a further embodiment, the secondary or pre-squeegee includes a trap for collecting solid or large debris from the wastewater that includes a drain to permit wastewater to return to the floor. This embodiment of the secondary or pre-squeegee reduces the load on the vacuum source when very heavy concentrations of wastewater, debris, or a combination thereof is encountered.

The present invention further provides a squeegee system that facilitates mounting of a squeegee rubber to a squeegee mount. The squeegee system includes a mount and a squeegee rubber that each posses complimentary engaging structures which, once the squeegee rubber is placed on the mount, prevent vertical displacement of the squeegee rubber. In one embodiment, the mount includes a crown and the squeegee rubber includes a slot that fits over the crown so that vertical displacement of the rubber relative to the crown is prevented. In another embodiment, the squeegee rubber includes slots on both sides of the squeegee rubber that can engage the crown as well as permit various edges of the squeegee rubber to be positioned adjacent to the floor surface. As a consequence, once one edge of the squeegee rubber has become worn, another edge of the rubber can be positioned adjacent to the floor surface.

Another embodiment of the squeegee system facilitates clamping of the squeegee rubber to the squeegee mount and further permits the squeegee rubber to extend beyond the ends of the mount, thereby facilitating use of the squeegee adjacent to walls and similar structures. The squeegee mount includes a pair of buttonheads that are located near the ends of the mount and are used to hold the squeegee rubber and a pair of restraining straps in place while the ends of the restraining straps are latched together to clamp the squeegee rubber to the squeegee mount. The squeegee rubber includes a pair of holes that engage the buttonheads and thereby hold the squeegee rubber in place while the restraining straps are put in place to clamp the squeegee rubber to the mount. The system further includes a pair of restraining straps each with a hole at one end that engages one of the buttonheads. An over-center latch is used to connect the other ends of the straps to one another and thereby clamp the squeegee rubber to the squeegee mount.

DETAILED DESCRIPTION

The present invention is directed to apparatuses for use in cleaning floors. At the outset, it should be appreciated that the term floor encompasses a number of surfaces including concrete, tile, stone, carpet, astroturf and the like.

Figure 1A:
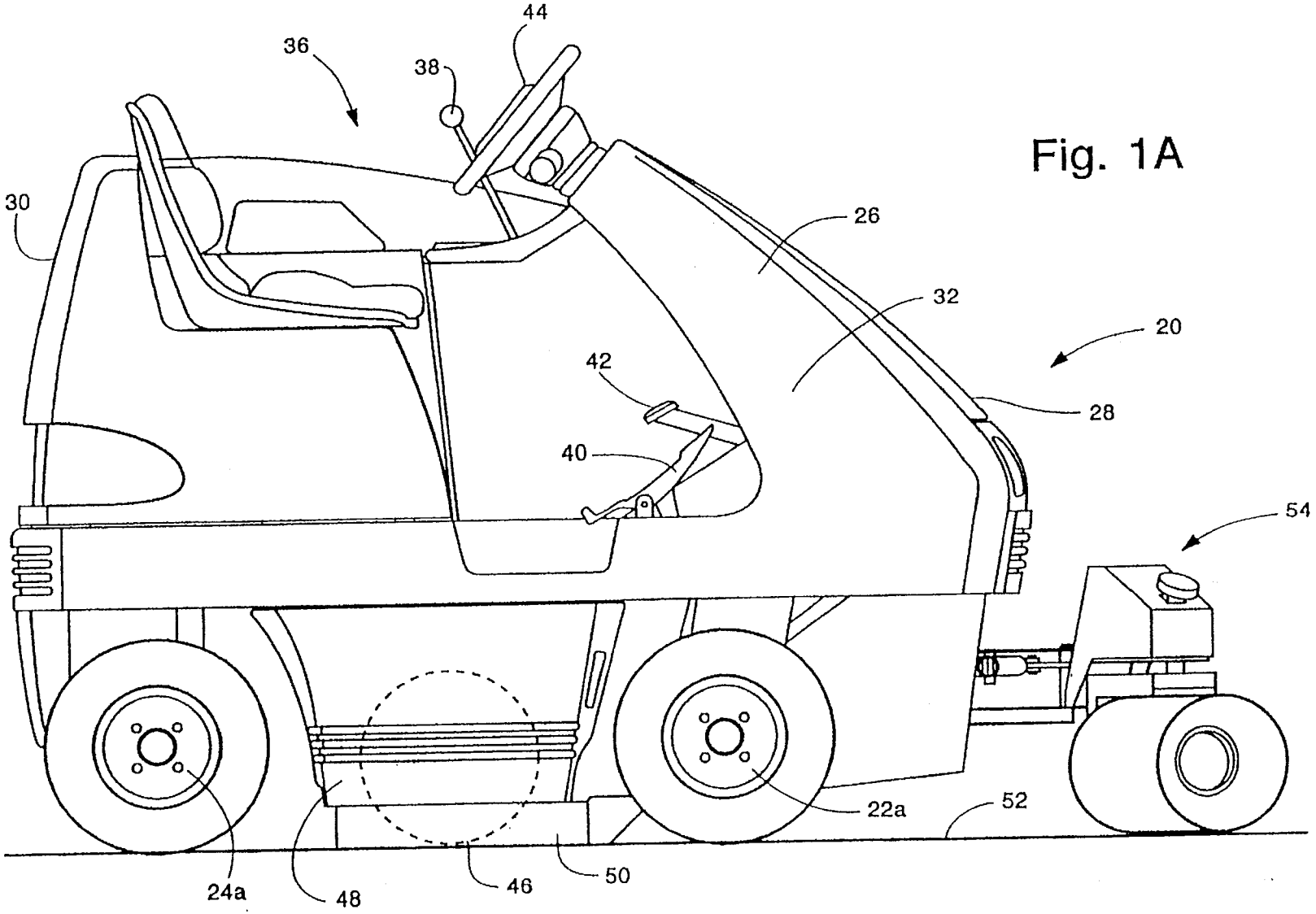
FIG. 1A is a right side view of a four-wheel sweeper that embodies a number of the inventions disclosed herein.
Figure 1B:
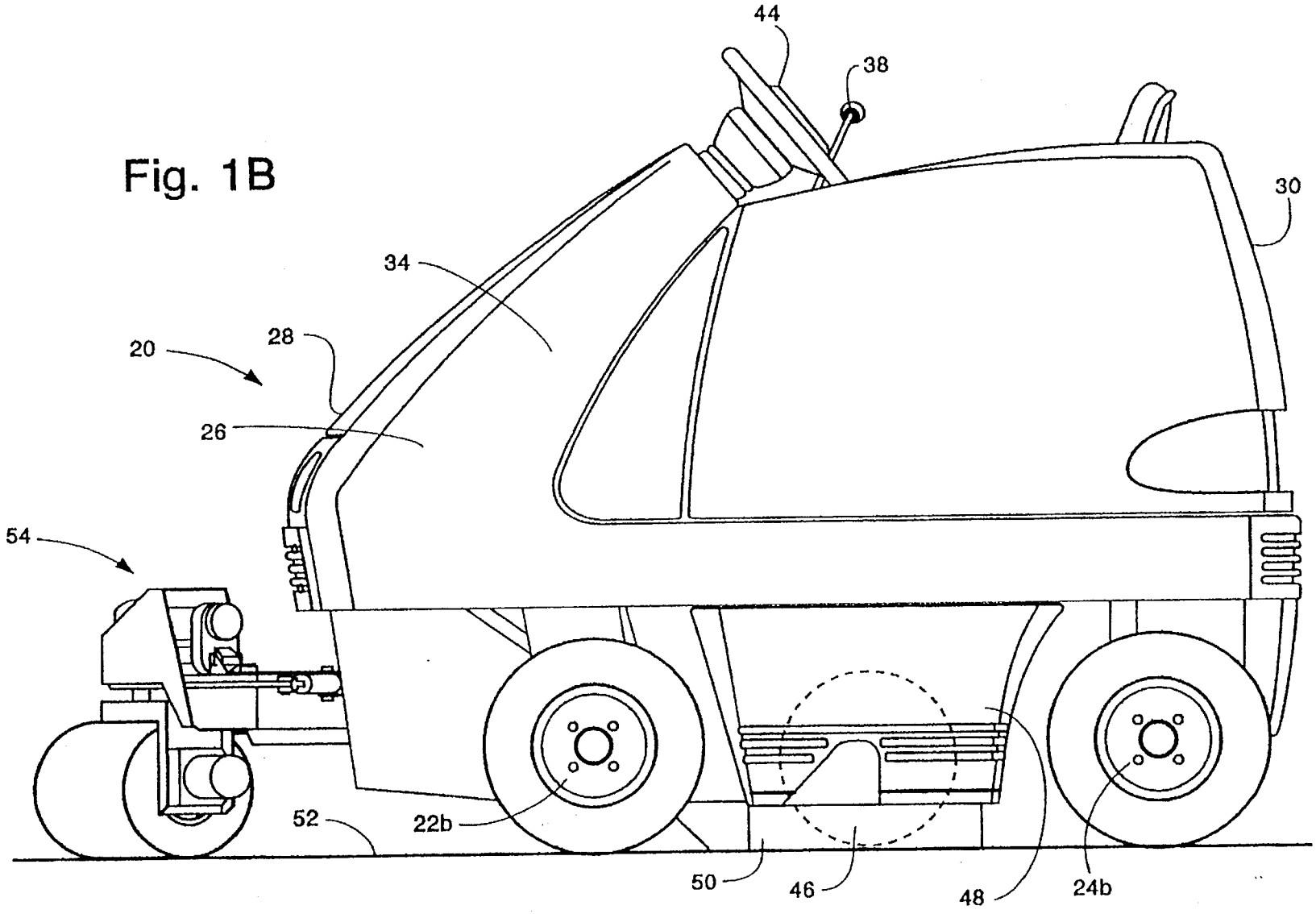
FIG. 1B is a left side view of the four-wheel sweeper illustrated in FIG. 1A.

FIGS. 1A and 1B illustrate an industrial sweeper 20, hereinafter referred to as sweeper 20, that incorporates a number of the inventions disclosed hereinafter. Generally, the sweeper 20 includes a frame (not shown) and four wheels, each operatively attached to the frame. The four wheels include two front, non-steerable wheels, 22A, 22B, and two rear, steerable wheels, 24A, 24B. Driving and braking of the wheels is accomplished by conventional drive train and braking systems (not shown) that are also operatively attached to the frame. Steering of the two rear, steerable wheels, 24A, 24B is accomplished by a steering system described hereinafter. Overlying the frame and operatively attached thereto is a body structure 26 that includes a front side 28, rear side 30, right side 32 and left side 34. The sweeper 20 further includes a driver or operators seat 36, which provides access to a gear shift 38 and an accelerator pedal 40 for controlling the drive train, a brake pedal 42 for actuating the braking system, and a steering wheel 44 for use in turning the two rear, steerable wheels 24A, 24B. Also includes in the sweeper 20 is a first cylindrical broom 46 that is contained within a broom housing 48 that includes flaps 50 and that is used to lift debris from a surface 52 for subsequent collection in a hopper (not shown) that underlies the body 26. The first cylindrical broom 46 rotates about an axis that is substantially parallel to the surface 52 and is located in an area bounded by the body 26 or bound by the two front, non-steerable wheels 22A, 22B, and the two rear, steerable wheels 24A, 24B. Also included in the sweeper 20 is a cylindrical side broom mechanism 54 for sweeping debris from the area extending beyond either the right side 32 or the left side 34 of the body 26 into the path of the first cylindrical broom 46 for subsequent collection in the hopper. Having generally described the sweeper 20, various components thereof are now described in greater detail.

With reference to FIGS. 2A–2D, a steering system 68 for turning the two rear, steerable wheels 24A, 24B so that relatively short or tight radius turns can be made by the sweeper 20 is described. At the outset, it should be appreciated that the steering system described hereinafter with respect to the sweeper 20 can also be used with other floor cleaning devices, such as scrubbers, that have a need to make small or tight radius turns. Moreover, although the steering system described herein is used in conjunction with the rear wheels of the scrubber 20, the steering system can be used with the front wheels of floor cleaning devices in the appropriate circumstances.

Before describing the steering system 68 in detail, the relationship of the wheels to one another and to the frame is briefly described. The two front, non-steerable wheels 22A, 22B are attached to a front axle (not shown), which constitutes a portion of the frame of the sweeper 20 so that the planes of the wheels are substantially parallel to one another and so that a first center line 58 passing through the centers of the wheels is substantially perpendicular to the planes of the wheels. The two rear, steerable wheels 24A, 24B, each respectively include brackets 60A, 60B, that are pivotally connected to a rear axle 62, which is also a portion of the frame, via pins 64A, 64B.

With the foregoing description of the relationship of the wheels to one another and the relationship of the wheels to the frame in mind, the steering system for turning the two rear, steerable wheels 24A, 24B is now described. The steering system 68 includes a pair of rotatable arms 70A, 70B respectively associated with the two rear, steerable wheels 24A, 24B. The rotatable arms 70A, 70B each respectively include first ends 72A, 72B that are respectively rigidly attached to wheel brackets 60A, 60B and therefore capable of rotating about pins 64A, 64B. The rotatable arms 70A, 70B, also include second ends 74A, 74B for pivotally connecting to a pair of links described hereinafter. The steering system 68 further includes Pitman arms 76A, 76B, which each-respectively include first pivotal connection points 78A, 78B, that are pivotally connected to the rear axle 62. Pitman arms 76A, 76B also respectively include second pivotal connection points 80A, 80B and third pivotal connection points 82A, 82B for use in connecting the Pitman arms 76A, 76B to links described hereinafter. Further included in the steering system 68 is a first link 84 pivotally connected to the second end 74A of rotatable arm 70A and pivotally connected to the second pivotal connection point 80A of Pitman arm 76A. A second link 86 is pivotally connected to the second end 74B of rotatable arm 70B and pivotally connected to the second pivotal connection point 80B of the Pitman arm 76B. A third link 88 is pivotally connected to the third pivotal connection point 82A of Pitman arm 76A and pivotally connected to the third pivotal connection point 82B of the Pitman arm 76B.

The steering system 68 further includes a steering column connector 90 comprised of a bracket 92 that is rigidly connected to the rear axle 62. Disposed between the ends of the bracket 92 is a rotatable pin 94 to which the Pitman arm 76A is rigidly connected and to which a plate 96 is also rigidly connected. Rotatably connected to plate 96 is a steering column 98 that is operatively connected to the steering wheel 44.

Figure 2A:
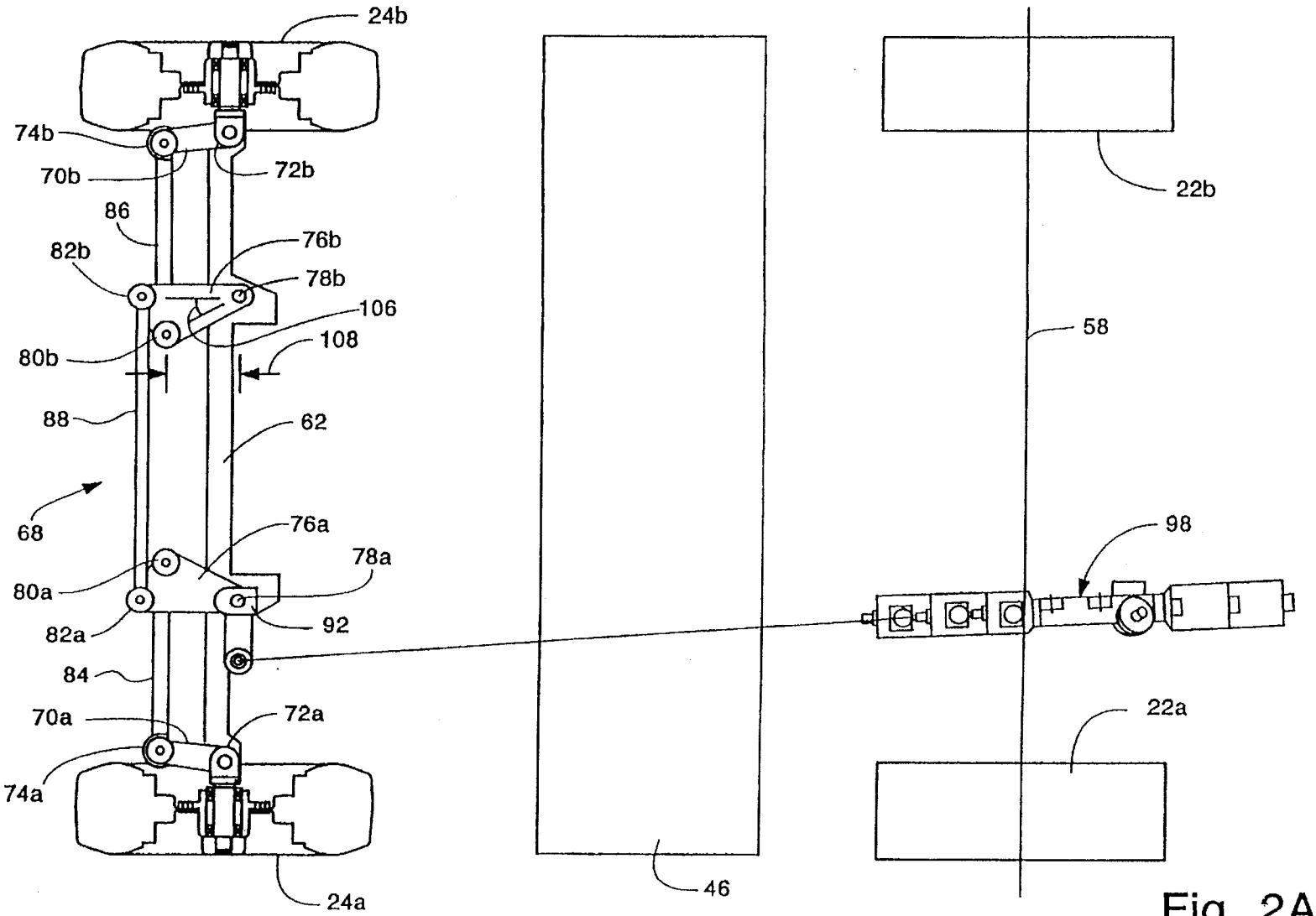
FIG. 2A is a free-body diagram that illustrates the steerable wheels in a straight forward position, the two-wheel steering mechanism that is capable of turning the steerable wheels in relatively tight turns, and the relationship of the wheels to the cylindrical broom.
Figure 2B:
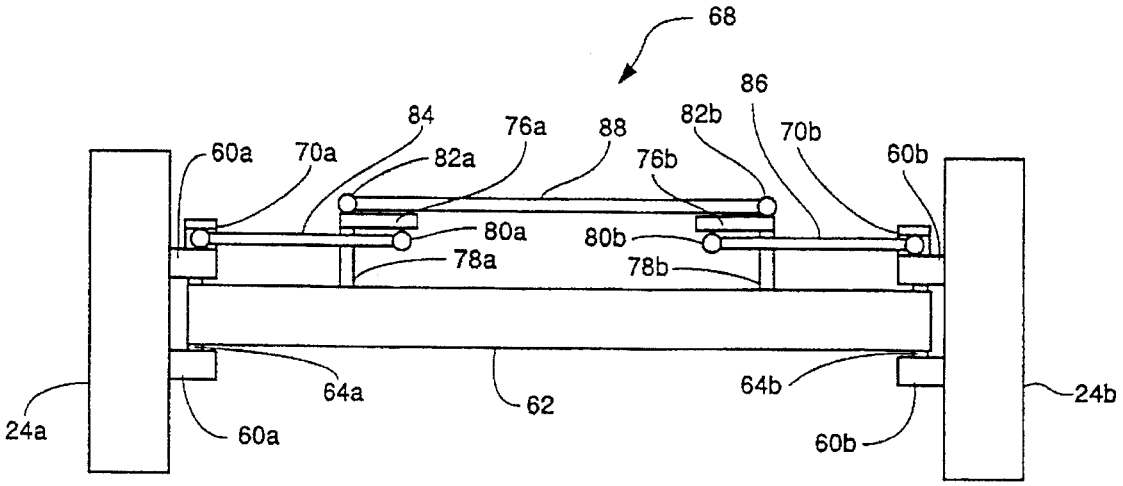
FIG. 2B is a front view of the two-wheel steering mechanism illustrated in FIG. 2A without the steering column linkage.
Figure 2C:
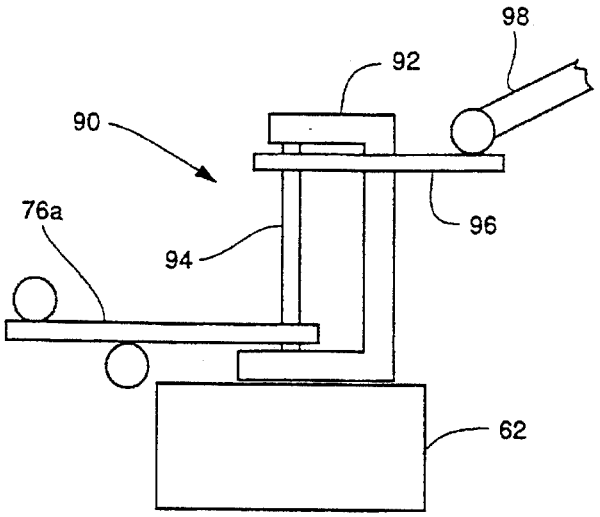
FIG. 2C illustrates the steering column linkage of the two-wheel steering mechanism shown in FIG. 2A.
Figure 2D:
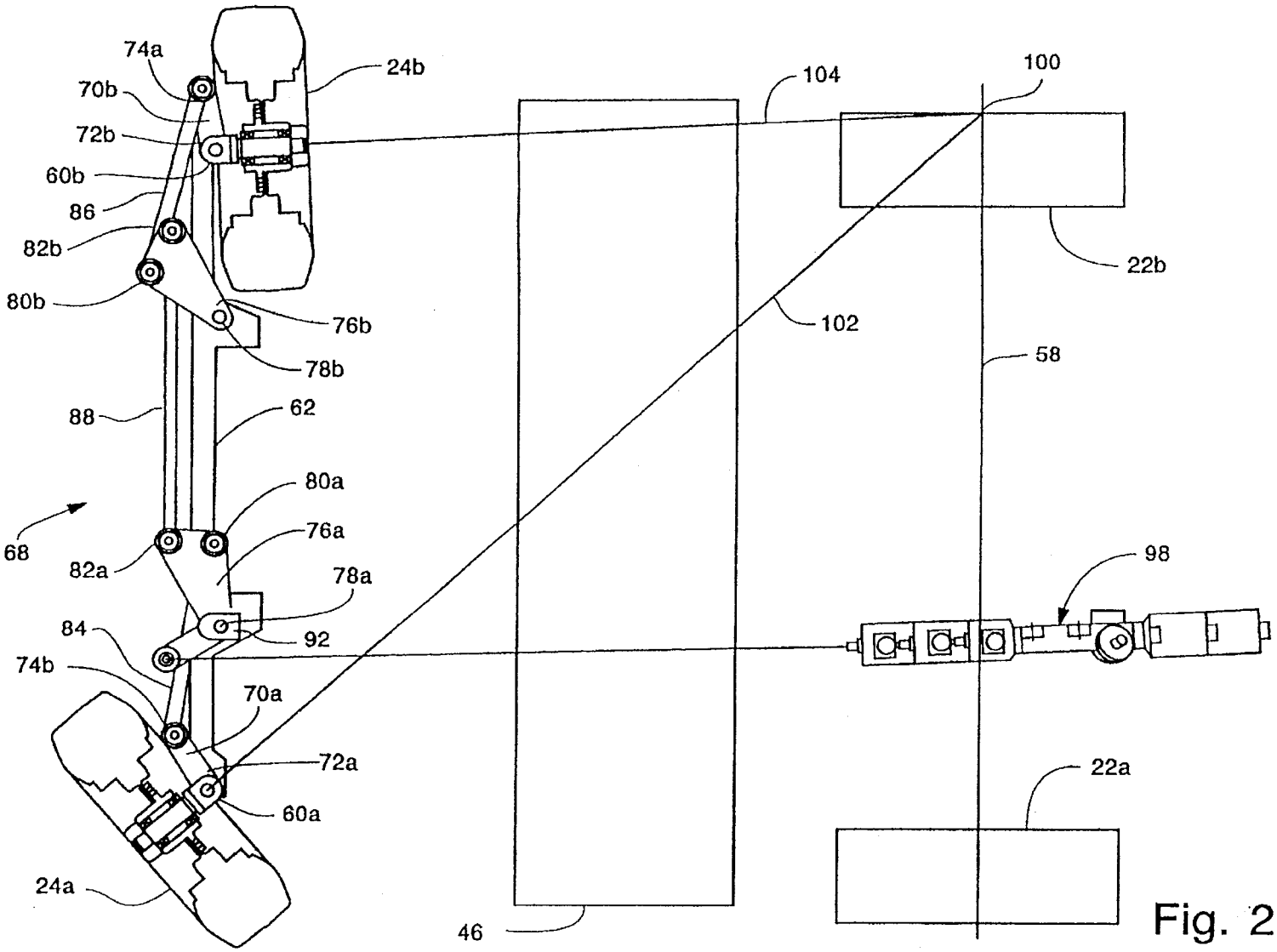
FIG. 2D is a free body diagram that illustrates one of the steerable wheels turned approximately 90° relative to the straight forward position shown in FIG. 2A, the two-wheel steering mechanism and the relationship of the wheels to the cylindrical broom.

With particular reference to FIG. 2D, operation of the steering system 68 is now described. Turning of the two rear, steerable wheels 24A, 24B commences with the operator turning the steering wheel 44. In response, the steering column 98 increases in length, as can be seen by comparison of FIGS. 2A and 2D. As a consequence, the plate 96, rotatable pin 94, and Pitman arm 76A rotate about the first pivotal connection point 78A. Due to the first link 84, rotation of the Pitman arm 76A causes the first rotatable arm 70A and rear, steerable wheel 24A to rotate about pin 64A. Similarly, due to the third link 88, rotation of the Pitman arm 76A causes the Pitman arm 78B to rotate about the first pivotal connection point 78B. Further, the rotation of the Pitman arm 76B, via the second link 86, causes rotation of rotatable arm 70B and steerable wheel 24B about pin 64B.

With continued reference to FIG. 2D, operation of the steering system 68 in making a short radius or tight turn is described. In order to make a U-turn from a first direction to a second direction in which the path of the first cylindrical broom 46 in the second direction is coincident, if not slightly overlapping with the path in the first direction, the sweeper 20 must be able to rotate about pivot point 100 on the first center line 58 extending between the two front, non-steerable wheels 22A, 22B. As a consequence, in such a turn, a second center line 102 that passes through the center of front steerable wheel 24A and a third center line 104 that passes through the center of rear, steerable wheel 24B must substantially converge at pivot point 100 on first center line 58. Moreover, for lesser turns, it is desirable that the second center line 102 and third center line 104 converge at points on the first center line 58 spaced outward from pivot point 100.

In order for the foregoing conditions to be satisfied, the steering system 68 must operate so that for a given turn of the steering wheel 44, the two rear, steerable wheels 24A, 24B, rotate about pins 64A, 64B, respectively, at different rates. Moreover, at least one of the two rear, steerable wheels 24A, 24B must turn through a relatively large angle. For example, as shown in FIG. 2D, the rear steerable wheel 24B has turned more than 75° and almost 90° relative to its position shown in FIG. 2A. The different rates at which the steering system 68 functions to rotate the two rear, steerable wheels 24A, 24B is a function of the angle between a first line extending from the first pivotal connection points 78A, 78B to the second pivotal connection points 80A, 80B and a second line extending from the first pivotal connection points 78A, 78B and the third pivotal connection points 82A, 82B of the Pitman arm 76A, 76B. These angles are chosen so that the two rear, steerable wheels 24A, 24B turn at rates such that the second center line 102 and the third center line 104 substantially always converging on a point on the first center line 58 and so that, for the noted U-turn condition, the second center line 102 and third center line 104 converge at pivot point 100. The extent to which the two rear, steerable wheels 24A, 24B can be turned is a function of the longitudinal distance between the first pivotal connection points 78A, 78B and the second pivotal connection points 80A, 80B of the Pitman arm 76A, 76B. More specifically, as the longitudinal distance 106 increases, the angle through which the rear, steerable wheels 24A, 24B, can be turned increases. Consequently, to make the turn about pivot point 100, the angle 106 and longitudinal distance 108 of the Pitman arms 76A, 76B must be chosen in order to satisfy the noted convergence conditions.

Figure 2E:
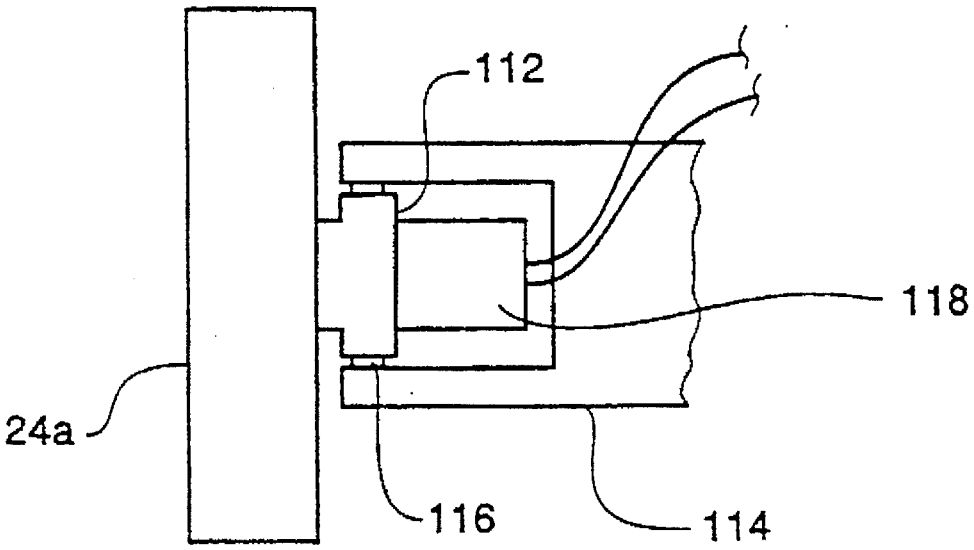
FIG. 2E illustrates a steerable wheel that can be used with the two-wheel steering mechanism shown in FIG. 2A and a motor for driving the wheel as well.
Figure 2F:
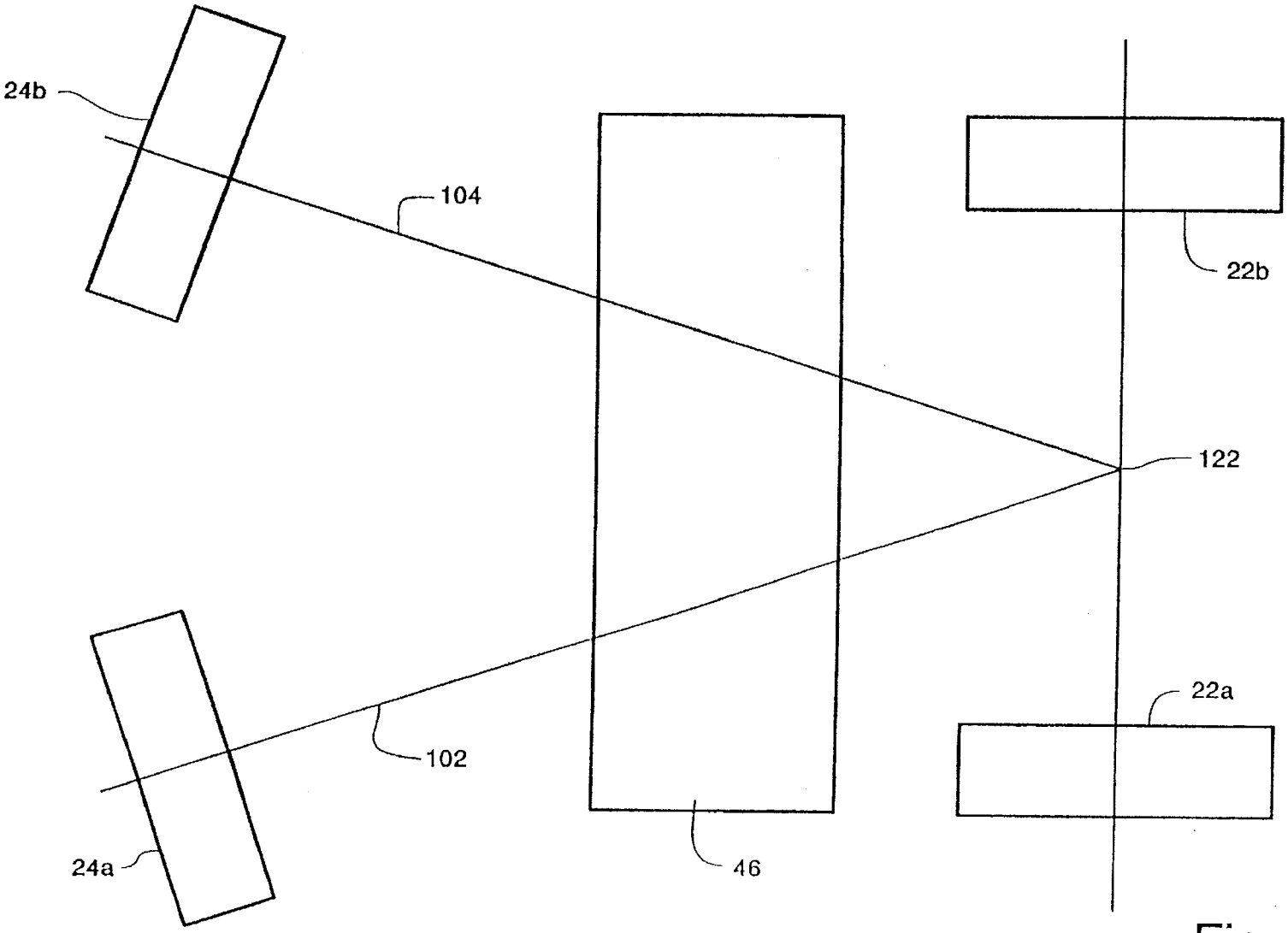
FIG. 2F is a free body diagram that illustrates the two-steerable, drive wheels in a turned position and the relationship of the wheels to the cylindrical broom.

While the steering system 68 has been described with the understanding that the two, front non-steerable wheels 22A. 22B, are the driven or powered wheels, it is also possible for the two rear, steerable wheels 24A, 24B to be the driven or powered wheels. FIG. 2E, although limited to wheel 24A, shows one way in which the two rear, steerable wheels 24A, 24B can be driven or powered. Specifically, the wheel 24A includes a Wheel bracket 112 that is attached to a "wishbone" rear axle 114 by a pin 116 that permits the wheel 24A to rotate about the pin 116. An electric motor 118 is located within the "wishbone" portion of the rear axle 114 to drive or power the wheel 24A.

When the two rear, steerable wheels 24A, 24B are powered or motorized, the requirement that the second center line 102A associated with wheel 24A and the third center line 104 associated with the rear, steerable wheel 24B substantially converge on a point on the first center line 58 throughout the turn remains. However, the two rear, steerable wheels 24A, 24B must now be able to turn to an extent so that for the noted U-turn condition, the second center line 102 and third center line 104 converge at a point 122 on the first center line 58 that is between and preferably midway between the two front, non-steerable wheels 22A, 22B. To meet these criteria, a slight modification of the steering system 68 shown if FIG. 2A is required. Specifically, for the two rear, steerable wheels 24A, 24B in the straight forward condition shown in FIG. 2A, the Pitman arms 76A, 76B must be biased slightly to the right or left and, as a consequence, the first link 84 and the second link 86 must be made slightly different lengths, depending upon the degree to which the Pitman arms 76A, 76B are biased or rotated either right or left from that shown in FIG. 2A. With this modification, the rear, steerable wheel 24B can be turned more than 90° and the aforementioned criteria satisfied. However, this modification only allows the maximum turn to be made in one direction, either right or left, because there is less linkage to make the tightest possible turn in the other direction.

Figure 2G:
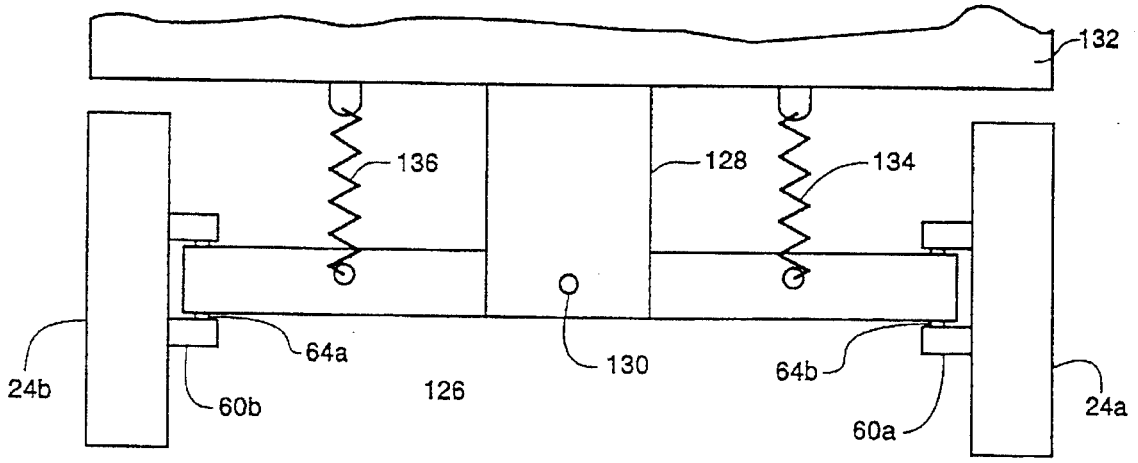
FIG. 2G illustrates a suspension mechanism that can be used with the steerable wheels or steerable, drive wheels to facilitate movement of the sweeper over uneven terrain.

In many instances, the surface to be cleaned is uneven. To assure that the two front, non-steerable wheels 22A, 22B and the two rear, steerable wheels 24A, 24B all remain on such a surface, the steering system 68 can be mounted on a floating rear axle 126 as shown in FIG. 2G. The floating rear axle 126 is attached to the two rear, steerable wheels 24A, 24B as previously described with respect to FIG. 2A. It should also be understood that the floating rear axle 126 can be attached to motorized wheels as described with respect to FIG. 2E. The floating rear axle 126 is also pivotally attached to vertical frame member 128 at pivot connection point 130. Consequently, the floating rear axle 126 is free to rotate about the pivot connection point 130 when the sweeper 20 is moving over irregular or uneven surfaces. The vertical frame member is operatively connected to horizontal frame member 132. A first spring 134 extends between the horizontal frame member 132 to a point on the floating rear axle 126 between the pivot connection point 13 and the rear, steerable wheel 24A. Similarly, a second spring 136 extends from the horizontal frame member 132 to a point on the floating rear axle 126 between the pivot connection point 130 and the rear, steerable wheel 24B. When one of the two rear, steerable wheels 24A, 24B encounters a bump or other obstacle on the surface, the floating rear axle 126 rotates about pivot connection point 130 thereby compressing one of the first spring 134 and the second spring 136 and stretching the other of the first spring 134 and the second spring 136. After the rear, steerable wheel 24A, 24B passes over the bump or other obstacle, the first spring 134 and the second spring 136 operate to return the floating rear axle 126 to its normal position, i.e., substantially perpendicular to the vertical frame member 128.

With reference to FIGS. 3A–3G, the cylindrical side broom mechanism 54, which provides superior results relative to disk side brooms and can increase the sweep path of the sweeper 20 is described. Generally, the cylindrical side broom mechanism 54 includes cylindrical side broom 140 and arm 142 for operatively connecting the cylindrical side broom 140 to the sweeper 20 via mount 144, a portion the frame. The arm also provides the ability to position the cylindrical side broom 140 in various locations as hereinafter described. Additionally the arm 142 serves as a mount for an electric motor 146 that is used to rotate the cylindrical side broom 140.

The arm 142 includes a first arm 150 that is pivotally attached to the mount 144 so that the cylindrical side broom 140 can be moved between the right side 32 and the left side 34 of the sweeper 20. The arm 142 also includes a second arm 154 that is pivotally attached to the first arm 150 at second pivot point 156 so that the cylindrical side broom 140 can be moved between an operative position adjacent to the surface 152 and a stowed position away from the surface 52. The arm 142 further includes a third arm 158 that is pivotally attached to the second arm 154 at third pivot point 160 so that the cylindrical side broom 140 can rotate about a vertical axis should an obstacle be encountered, thereby reducing the possibility of damaging the cylindrical side broom mechanism 54 in such a situation. The arm 142 also includes a height adjustment mechanism that permits the operator, via knob 164, to adjust the height of the cylindrical side broom 140 relative to the surface 52. With this general background in mind, the various articulations of the cylindrical side broom 140 provided by the arm 142 and the height adjustment mechanism are hereinafter described in greater detail.

Figure 3A:
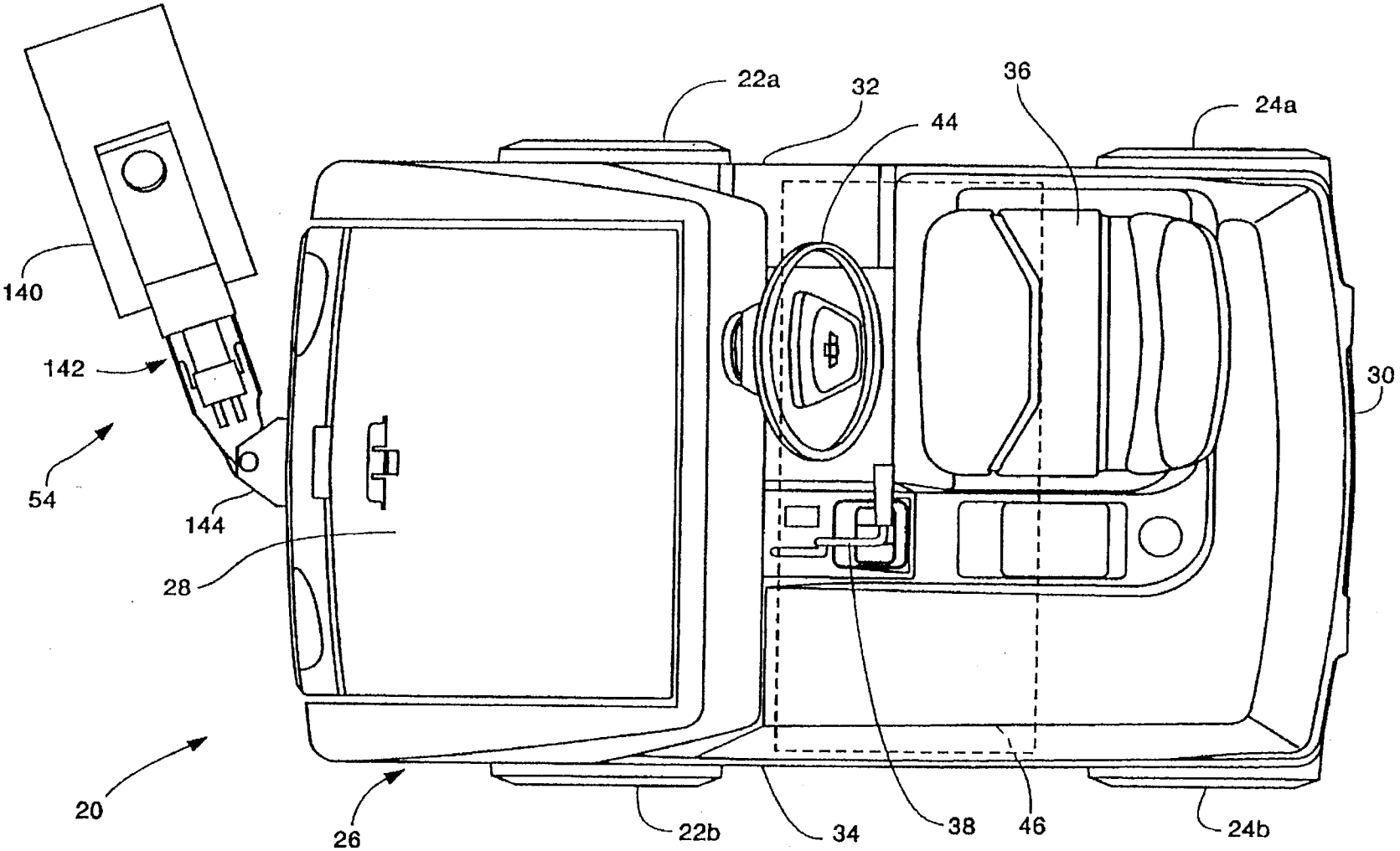
FIG. 3A is a top-view of the sweeper shown in FIG. 1A that illustrates the relationship between the housed cylindrical broom and the external cylindrical broom.
Figure 3B:
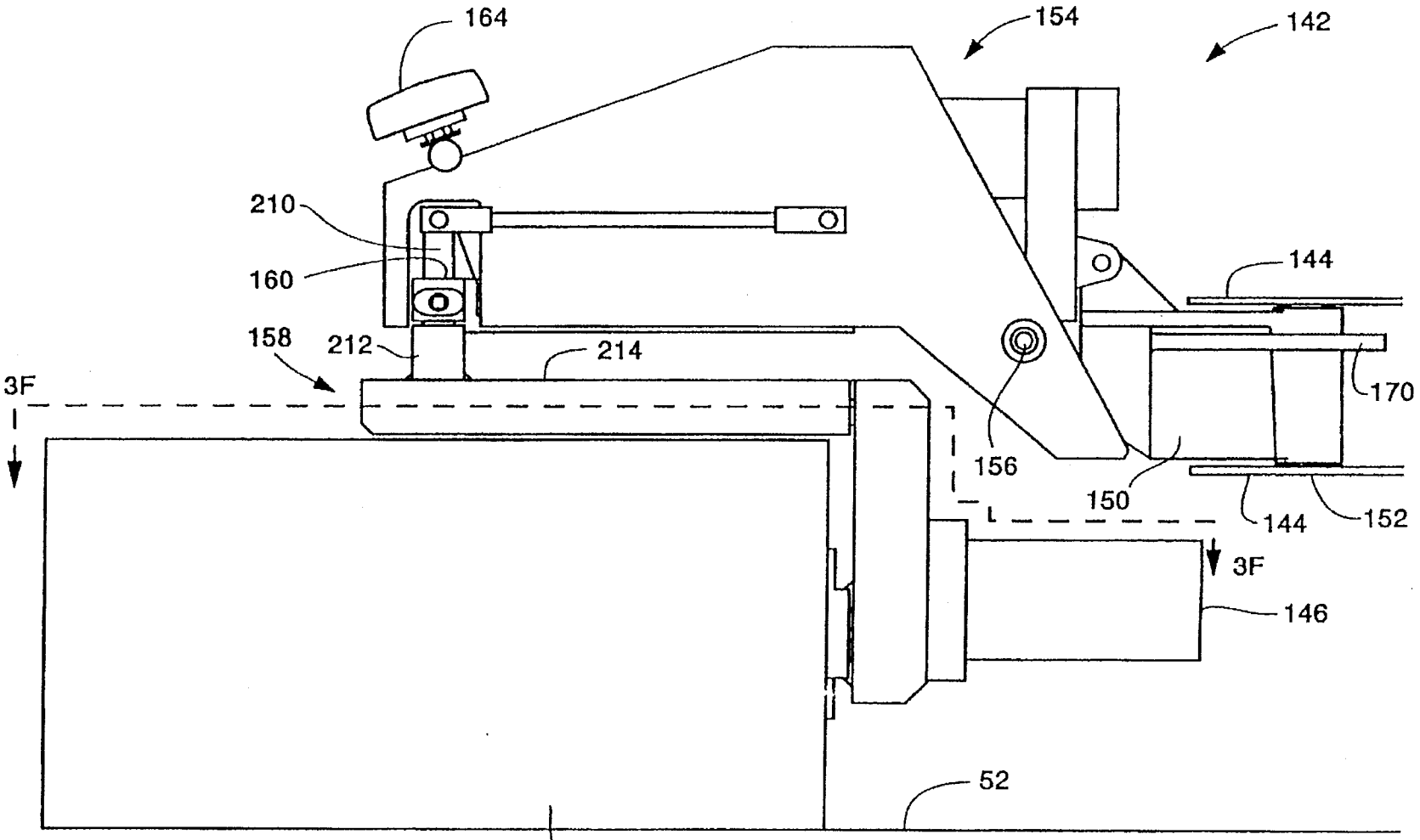
FIG. 3B is a front view of the cylindrical side broom mechanism.
Figure 3C:
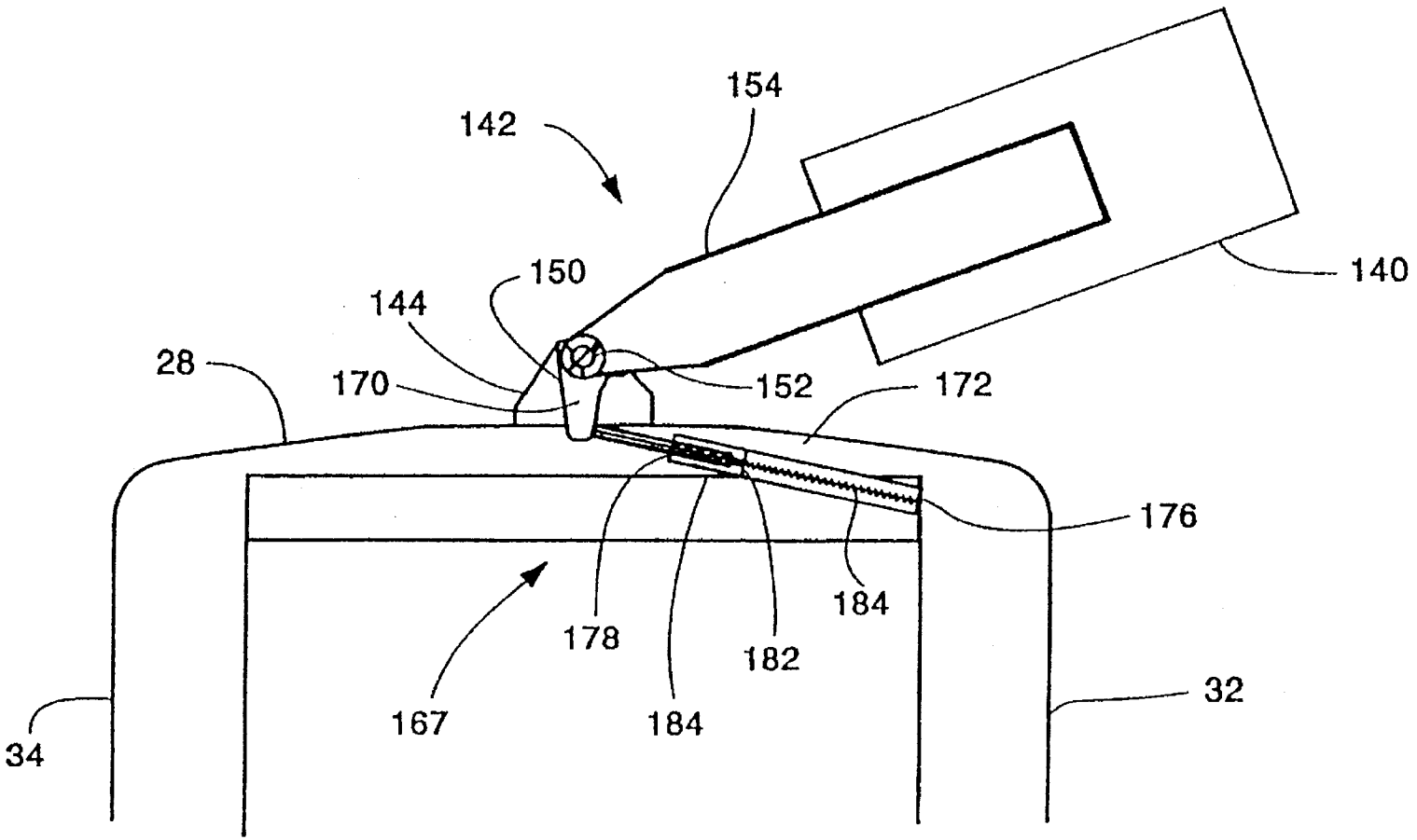
FIG. 3C illustrates the mechanism that permits the cylindrical side broom to be positioned on either the right side or the left side of the sweeper after deployment.

With reference to FIG. 3C, a right/left positioning mechanism 168 for use in positioning the cylindrical side broom 140 on either the right side 32 or the left side 34 of the sweeper 20 and for reducing the possibility of damage to the mechanism 54 should the cylindrical side broom 140 encounter an obstacle is described. The right/left positioning mechanism 168, hereinafter referred to as positioning mechanism 168, includes a flange 170 that is part of the first arm 150 and extends outward from the first pivot point 152. The positioning mechanism 168 also includes a first piston device 172 that is comprised of a housing 174 with a first end 176 that is pivotally attached to the sweeper 20 and a second end 178, a rod 180 with a first end pivotally attached to the flange 170 and a second end attached to a piston 182 located within the housing 174. The first piston device 172 further includes a first spring 184 located between the first end 176 of the housing 174 and the piston 182 and a second spring that is located between the second end 178 of the housing 174 and the piston 182. The positioning mechanism 168 operates to maintain the arm 142 in the position illustrated in FIG. 3C for sweeping along the right side of the sweeper 20 and in a comparable position for sweeping along the left side 34 of the sweeper 20. In these positions the force applied by the first spring 184 to the piston 182 is substantially equal to the force applied by the second spring 186 to the piston 182. As a consequence, the rod 180 holds the flange 170 of the first arm 150 and hence the entire arm 142 in the position shown in FIG. 3C and in a comparable position when the cylindrical side broom 140 is positioned adjacent to the left side 43 of the sweeper 20.

If the arm 142 is displaced within a certain range of the noted operating positions, the force applied by the first spring 184 to the piston 182 and the force applied by the second spring 186 to the piston 182 are no longer equal, and the springs then operate to return the arm 142 and hence the cylindrical side broom 140 to one of the two noted operating positions. This is especially useful if, for example, the cylindrical side broom 140 encounters an obstacle. In such a situation the arm 142 will rotate and serve to reduce the possibility of the cylindrical side broom mechanism 54 being damaged.

If the arm 142 is rotated from one of the two noted operating positions to a point beyond a defined range, then the positioning mechanism 168 operates to position the arm 142 in the other operating position. For example, if the arm 142 shown in FIG. 3C is rotated in a counter-clockwise direction from the operating position adjacent the right side 32 of the sweeper, to a point past a line that is approximately perpendicular to the front of the sweeper 20, then the positioning mechanism 168 will operate to position the arm 142 in the second operating position adjacent the left side 34 of the sweeper 20. Conversely, if the arm 142 is in the operating position adjacent the left side 34 of the sweeper and the arm is subsequently rotated past a line that is approximately perpendicular to the front of the sweeper 20, the positioning mechanism 168 will operate to position the arm 142 in the operating position adjacent the right side 32 of the sweeper 20.

Figure 3D:
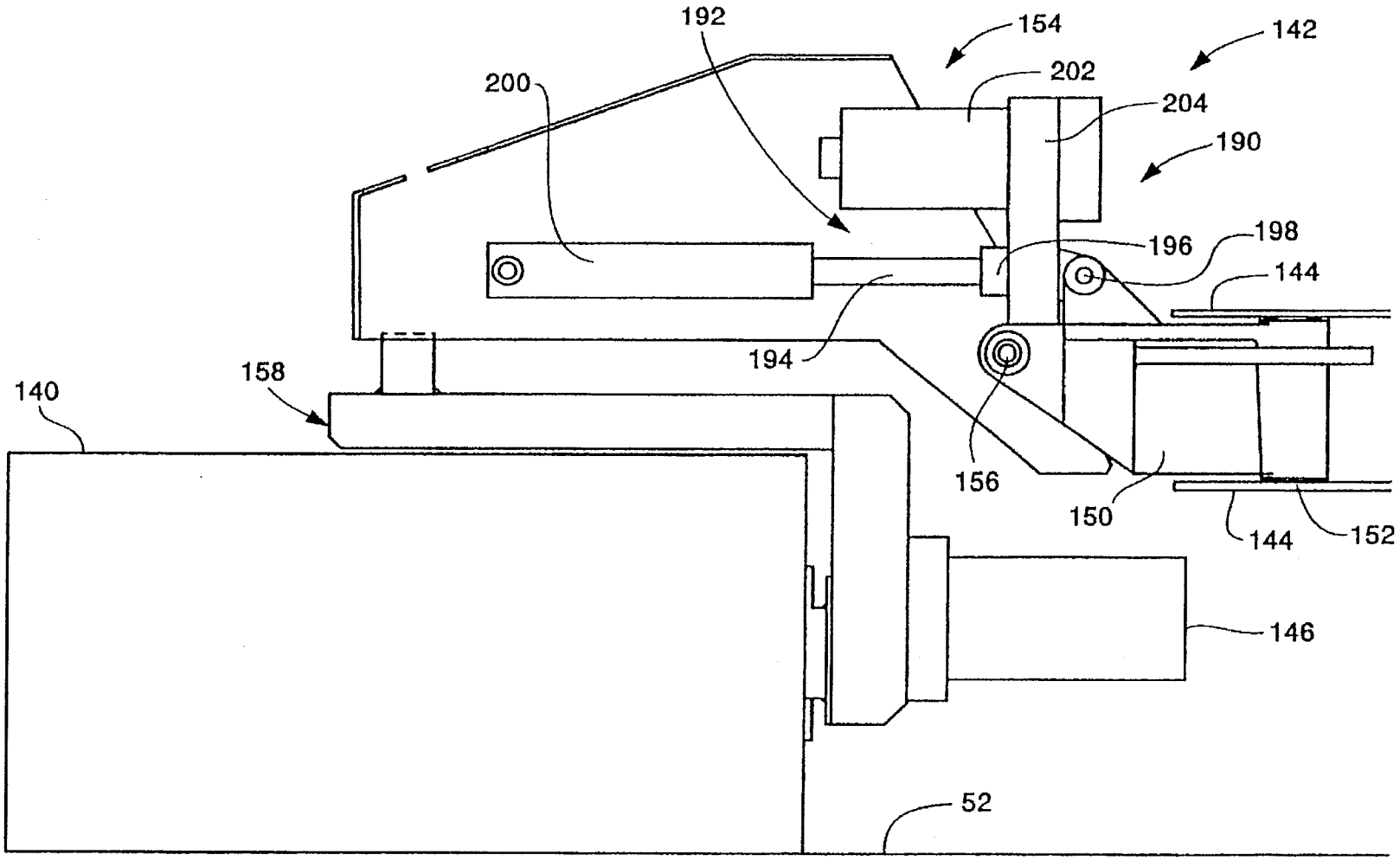
FIGS. 3D and 3E illustrate the mechanism used to move the cylindrical side broom between an operative location adjacent to the surface to be swept and a stowed location.
Figure 3E:
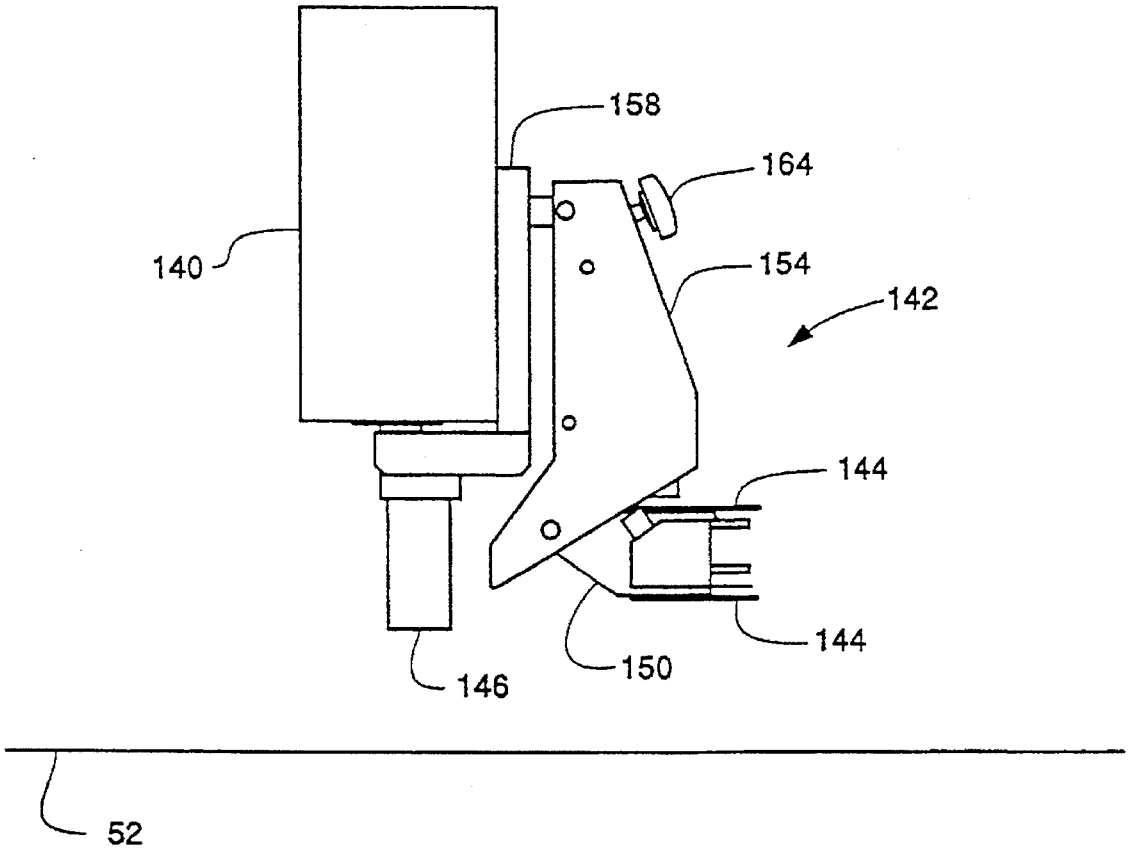

With reference to FIGS. 3D and 3E, a deployment mechanism 190 for moving the cylindrical side broom 140 between an operating position in which the cylindrical side broom 140 is positioned adjacent to the surface 52 and a stowed position in which the cylindrical side broom 140 is positioned away from the surface 52 is described. The deployment mechanism 190 includes a screw device 192 that includes a screw 194, a housing 196 for retaining a first end of the screw 194 that is pivotally attached to the first arm 150 at pivot point 198, and a threaded tube 200 for retaining the second end of the screw 194. The deployment mechanism 190 further includes an electric motor 202 and a gear box 204 for connecting the electric motor 202 and the screw 194 in a manner that permits the screw 194 to be rotated clockwise or counter clockwise by the electric motor 202.

To move the cylindrical side broom 140 between the operating position shown in FIG. 3D and the stowed position shown in FIG. 3E, the gear box 204 is set by the operator so that when the electric motor 202 is energized, the screw 194 will turn in a clockwise direction. As the screw 194 turns in a clockwise direction, the threaded tube 200 is drawn towards the housing 196 and, as a result, the second arm 154, third arm 158 and cylindrical side broom 140 all rotate about the second pivot point 156 until positioned as shown in FIG. 3E. To move the cylindrical side broom 140 from the stowed position shown in FIG. 3E to the operating position shown in FIG. 3D, the aforementioned process is repeated except that the gear box 204 is set to cause the screw 194 to rotate in a counter clockwise direction rather than a clockwise direction.

Figure 3F:
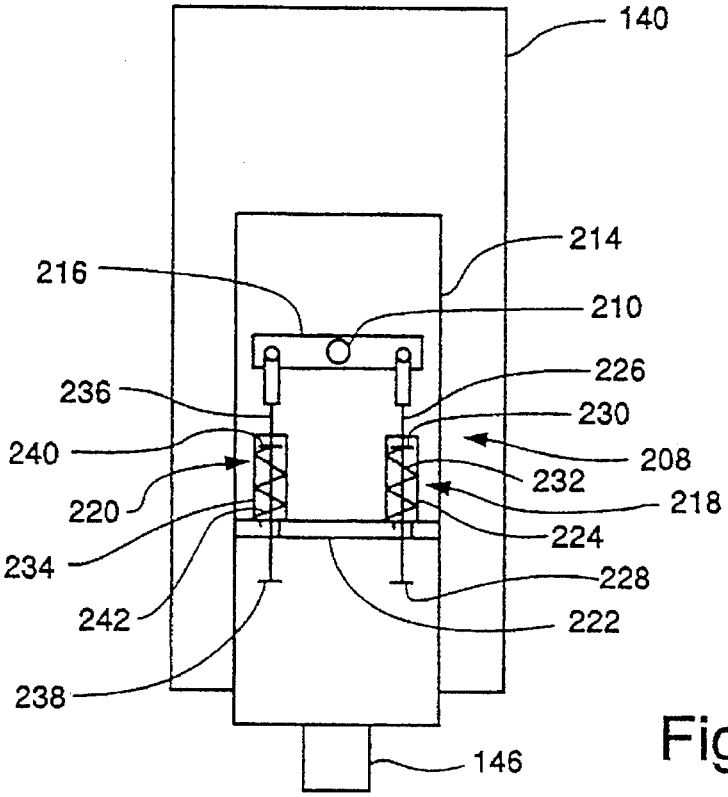
FIGS. 3F and 3G illustrate the mechanism that permits the cylindrical side broom to pivot about a vertical axis located between the ends of the broom.
Figure 3G:
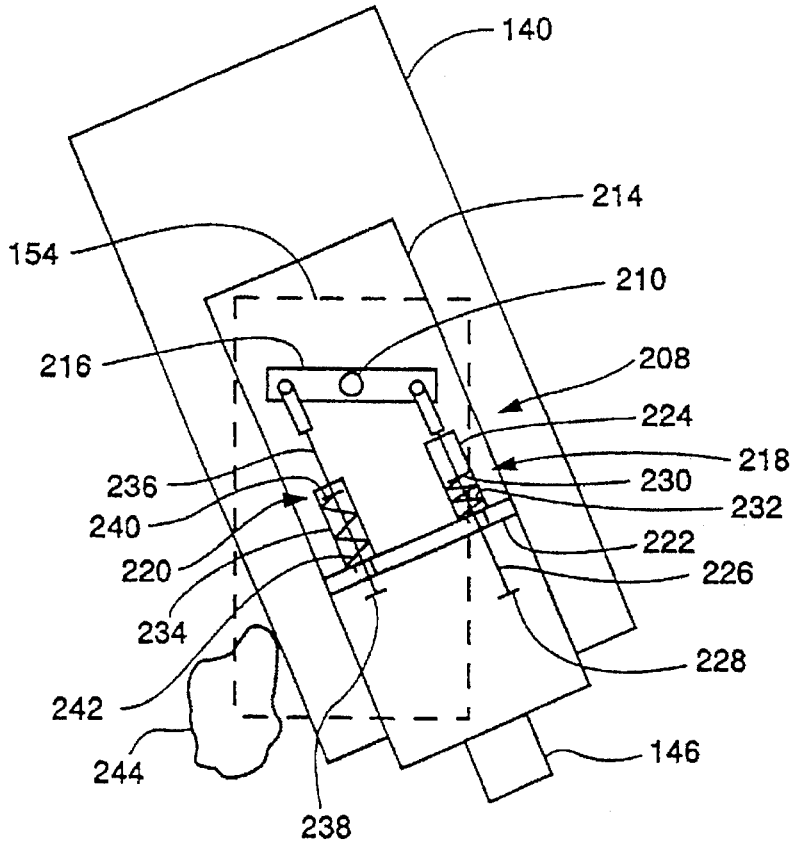

With reference to FIGS. 3F and 3G, the mechanism that permits the cylindrical side broom 140 to spin or pivot about a vertical axis between its ends, hereinafter referred to as spin mechanism 208, is described. The ability to pivot the cylindrical side broom 140 in this manner reduces or avoids damage to the cylindrical side broom mechanism 58 should an obstacle be encountered. With reference to FIG. 3B, the spin mechanism 208 includes a pin 210 that is attached to the second arm 154 in a manner that prevents the pin 210 from spinning or rotating about its longitudinal axis. At least a portion of the pin 210 passes through a collar 212 that forms part of a housing 214 of the third arm 158. Within the housing 214, the pin 210 is rigidly attached to a bar 216. Between the pin 210 and the collar 212 or housing 214 are bearings (not shown) that permit the third arm 158 to rotate or spin about the third pivot point 160. The spin mechanism 208 further includes a first piston device 218, a second piston device 220, and a wall 222 (all located within the housing 214) that cooperate with the bar 216 to keep the cylindrical side broom 140 and the third arm 158 aligned with the second arm 154 but also permit the cylindrical side broom 140 and third arm 158 to rotate or spin relative to the second arm should an obstacle be encountered by the cylindrical side broom 140.

The first piston device includes a first piston housing 224 and a first piston rod 226 with one end attached to an end of the bar 216 and the other end, which passes through the wall 222, attached to a first retaining ring 228. Located between the ends of the first piston rod 226 and within the first piston housing 224 is a first piston 230. Also disposed in the first piston housing 224 is a first piston spring 232 disposed between the first piston 230 and the wall 222. Similarly, the second piston device 220 includes a second piston housing 234, a second piston rod 236, second retaining ring 238, second piston 240, and second spring 242. The relationships of the various components of the second piston device 220 are identical to that of the first piston device except that the second piston rod is attached to the other end of the bar 216 to which the first piston rod 226 is attached.

With reference to FIGS. 3A and 3F, during normal operation of the sweeper 20, the spin mechanism 208 operates to keep the cylindrical side broom 140 and the third arm 258 aligned with the second arm 254. This result is achieved by the first piston spring 232 and the second piston spring 242 applying substantially equal forces to the third arm 158 via the wall 222. With reference to FIG. 3G, if the cylindrical side broom 140 encounters an obstacle 244, the spin mechanism 208 permits the cylindrical side broom 140 and the third arm 158 to rotate about the third pivot point 160. Once, however, the obstacle is removed or otherwise avoided, the spin mechanism 208 operates to realign the cylindrical side broom 140 and third arm 158 with the second arm 154. This is achieved by the first piston spring 232 applying a force to the third arm 158 via the wall 222 that counteracts the rotation of the third arm 158 resulting from the cylindrical side broom 140 encountering the obstacle 244. The second piston device 220 operates in a substantially identical manner when an obstacle causes the cylindrical side broom 140 and the third arm 158 to rotate in the opposite direction from that shown in FIG. 3G.

Figure 3H:
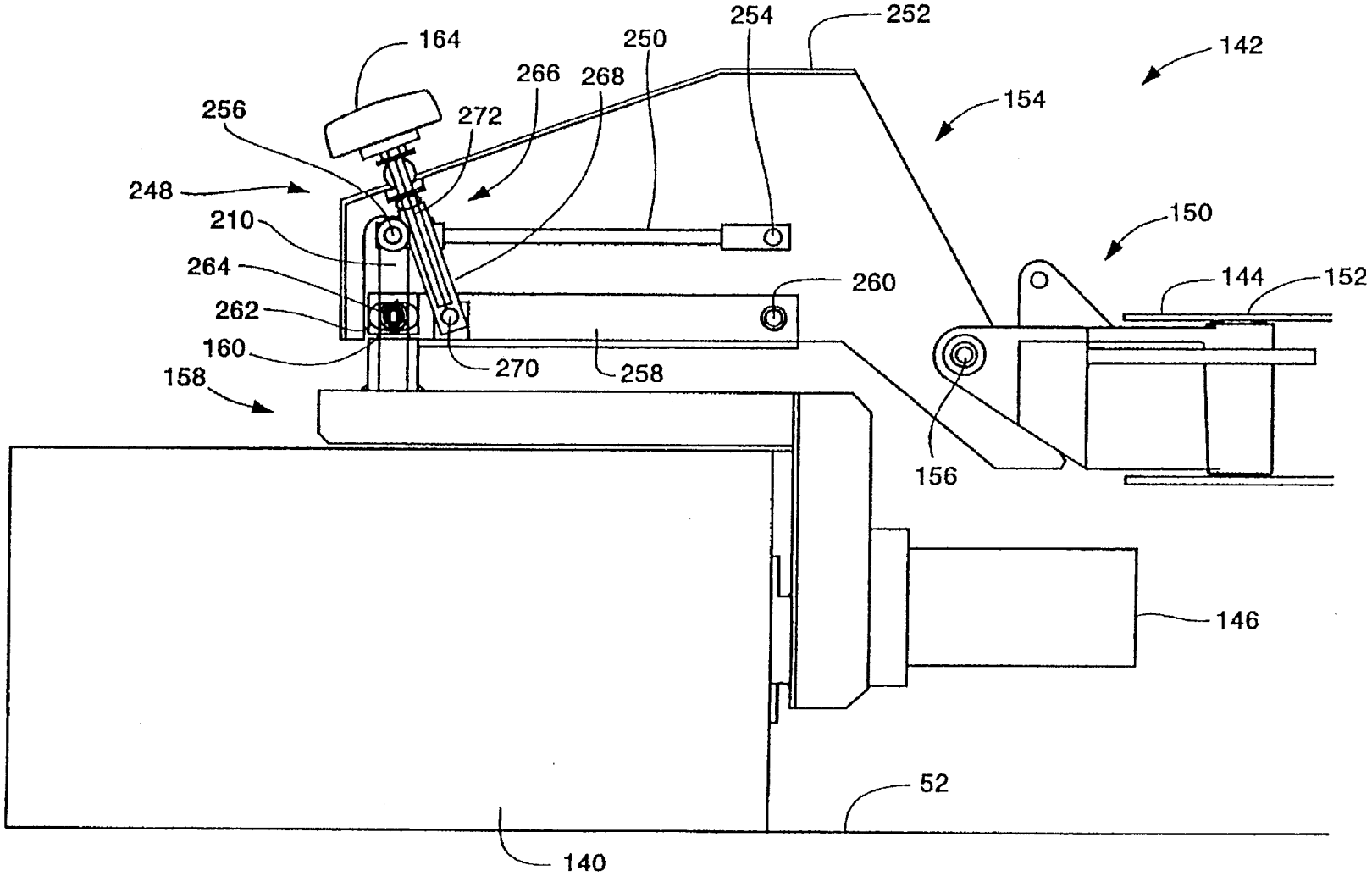
FIG. 3H illustrates the mechanism for adjusting the height of the cylindrical side broom relative to the surface.

With reference to FIG. 3H, a mechanism for adjusting the height of the cylindrical side broom 140 relative to the surface 52, hereinafter referred to as height adjustment mechanism 248, is discussed. Height adjustment mechanism 248 includes a first arm 250 with a first end thereof pivotally attached to a housing 252 of the second arm 154 at a first pivot point 254 and a second end thereof pivotally attached to pin 210 at second pivot point 256. The height adjustment mechanism 248 further includes a second arm 258 that has a first end pivotally attached to the housing 252 at a third pivot point 260, a second end that includes an oblong hole 262 for receiving a transverse pin 264 that is attached to the pin 210. Also included in the height adjustment mechanism 248 is a screw mechanism 266 that is used to rotate the second arm 258 about the third pivot point 260 and thereby effect height adjustment of the cylindrical side broom 140. The screw mechanism 266 includes a threaded tube 268 that is pivotally attached to the second arm 258 at fourth pivot point 270 and a screw 272 that is operatively connected to the knob 164.

Raising the height of the cylindrical side broom 140 is accomplished by rotating the knob 164 in a clockwise direction to cause the second arm 258 to rotate about the third pivot point 260. Rotation of the second arm 258 causes the surface of the second arm 258 that defines the oblong hole 262 to push upward against the transverse pin 262, thereby causing the pin 210 to move upward. As a consequence, the cylindrical side broom 140 and the third arm 158 are drawn closer to the second arm 154 thereby raising the height of the cylindrical side broom relative to the surface 52. The pivotal attachment of the first arm 250 to the pin 210 at the second pivot point 256 and the oblong hold 262 permit the third arm 158 to rotate about the second pivot point 256 such that all of the cylindrical side broom 140 is raised by substantially the same amount relative to the surface 52. Lowering of the cylindrical side broom 140 relative to the surface 52 is accomplished in substantially the same manner except that the knob 164 is turned in a counter clockwise direction rather than in a clockwise direction.

Figure 4A:
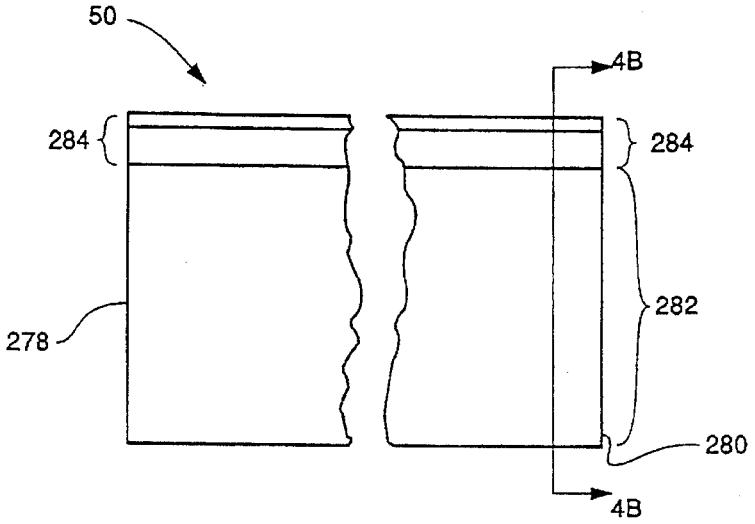
FIGS. 4A and 4B illustrate a flap or seal that can be slidably mounted to or removed from the sweeper illustrated in FIGS. 1A.
Figure 4B:
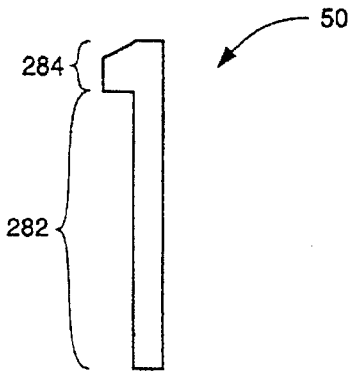
Figure 4C:
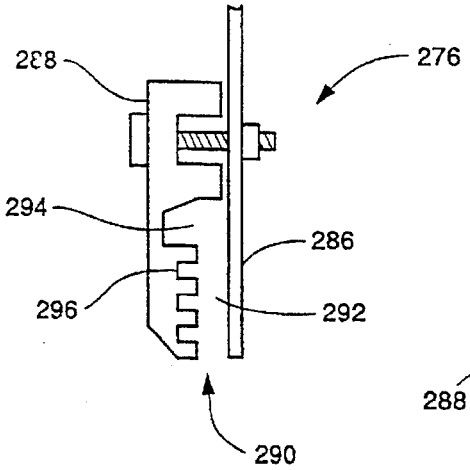
FIG. 4C illustrates the mounting mechanism on the sweeper for receiving the flap or seal illustrated in FIGS. 4A and 4B.
Figure 4D:
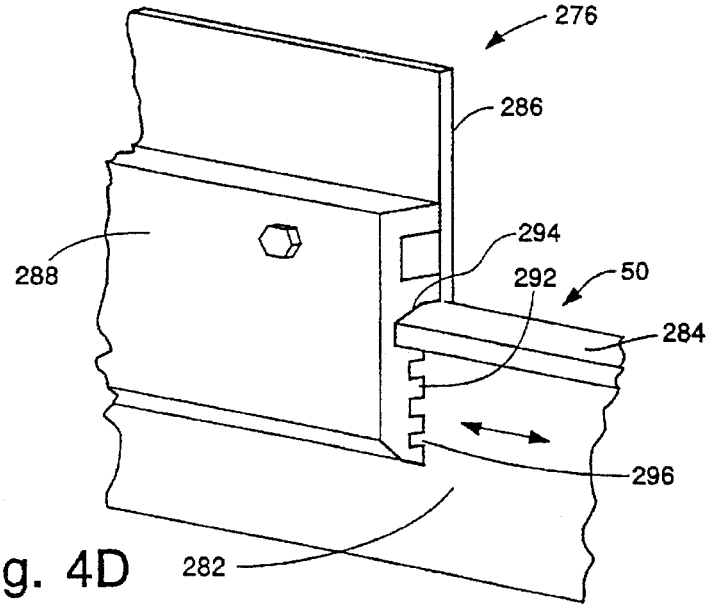
FIG. 4D illustrates the flap or seal illustrated in FIGS. 4A or 4B being slidably inserted into or removed from the mount illustrated in FIG. 4C.

With reference to FIGS. 4A–4D, the flap 50 which forms a portion of the broom housing 48 and a cooperating flap mounting structure that facilitate mounting and demounting of the flap 50 on to the sweeper 20 is discussed. The flap 50 extends longitudinally from a first terminal end 278 to a second terminal end 280 and includes a lower edge 282, at least a portion of which, when mounted to the sweeper 20, engages or is positioned substantially adjacent to the surface 52. The flap 50 further includes an upper edge 284 that is thicker than the lower edge 282. The flap mounting structure 276 illustrated in FIG. 4C includes a first portion 286 that cooperates with a second portion 288 to form a slot 290 for receiving the flap 50. The slot 290 includes a lower slot portion 292 for accommodating a portion of the lower edge 282 of the flap 50 and an upper slot portion 294 for accommodating the upper edge 284 of the flap 50. The slot 290 further includes a plurality of grooves 296 that reduce the surface contact area between the second portion 288 and the flap 50 to facilitate the sliding engagement between the flap 50 and the flap mounting structure 276. As illustrated in FIG. 4D, the flap 50 can be slidably inserted or slidably removed from the slot 290.

Figure 5A:
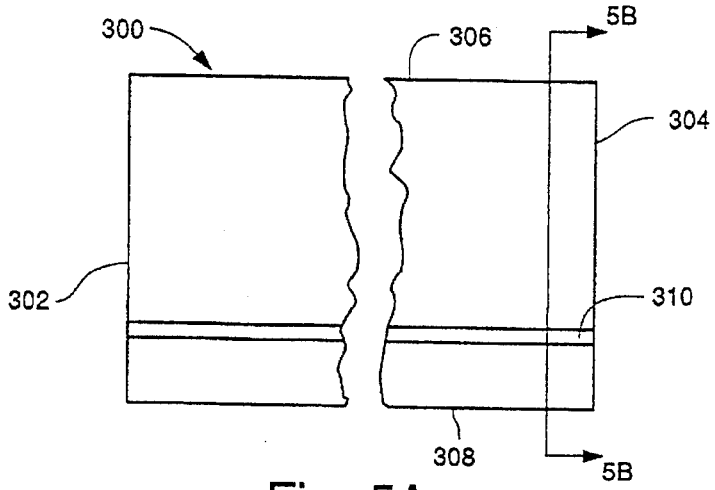
FIGS. 5A and 5B illustrate a flap or seal with a wear indicator.
Figure 5B:
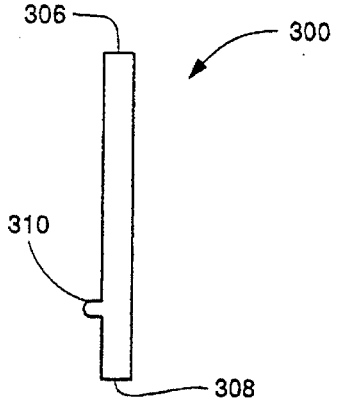

With reference to FIGS. 5A–5B, a flap 300 that employs a wear indicator to inform an operator when the flap 300 requires adjustment or replacement is discussed. The flap 300 extends longitudinally from a first terminal end 302 to a second terminal end 304 and extends vertically from an upper terminal edge 306 to a lower terminal edge 308. The flap 300 further includes a wear indicator 310 that, prior to use of the flap 300, is located between the upper terminal edge 306 and a lower terminal edge 308. The wear indicator 310 shown in FIGS. 5A and 5B is a bulb-like structure that extends from the first terminal end 302 to the second terminal end 304 of the flap 300. However, one or more discrete bulbs appropriately located between the upper terminal edge 306 and the lower terminal edge 308 can be employed. Furthermore, the wear indicator 310 can be a different color from the adjacent material to facilitate a determination of when the flap is worn to a point that requires adjustment or replacement. The wear indicator 310 can also be made from a different material than the adjacent portions of the flap. For instance, the wear indicator 310 can be made from a material that makes a different noise when engaging the surface 52 than the noise made by the adjacent material when engaging the surface 52, thereby providing an audio as well as a visual indication of when the flap requires adjustment or replacement. As an alternative to the use of a bulb structure, a line can be painted on a surface of the flap.

In operation, the flap 300 is initially mounted to the sweeper 20. The operator then periodically inspects the flaps to determine whether the lower terminal edge 308 is approaching the wear indicator 310 or has passed the wear indicator 310 thereby indicating that adjustment or replacement of the flap 300 is needed. If the wear indicator 310 makes an audio signal, then periodic inspection of the flap 300 can be reduced or avoided and the flap adjusted or replaced upon the operator hearing the audio signal.

Figure 6A:
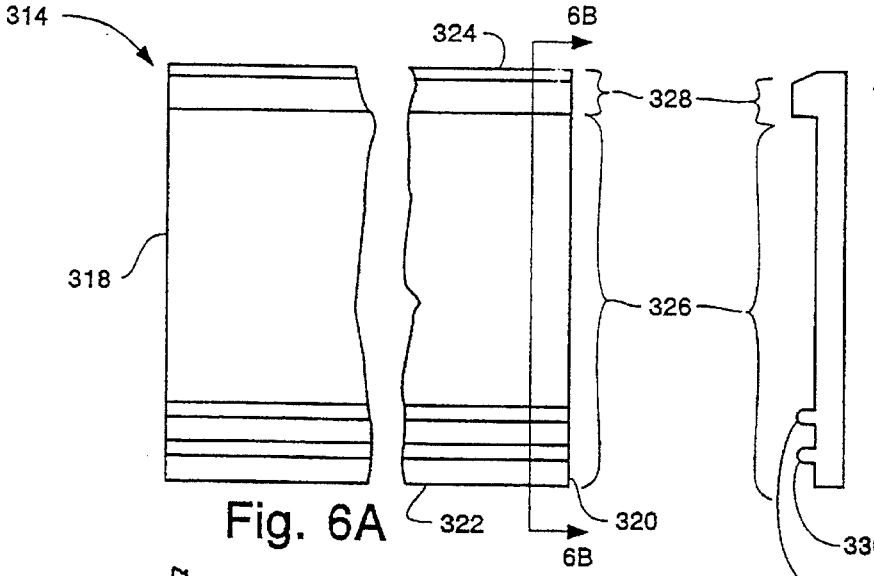
FIGS. 6A and 6B illustrate a flap or seal that can be slidably mounted or removed from a sweeper that also includes a plurality of wear indicators.
Figure 6B:
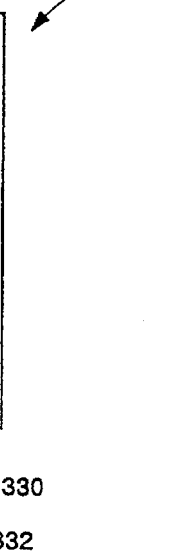
Figure 6C:
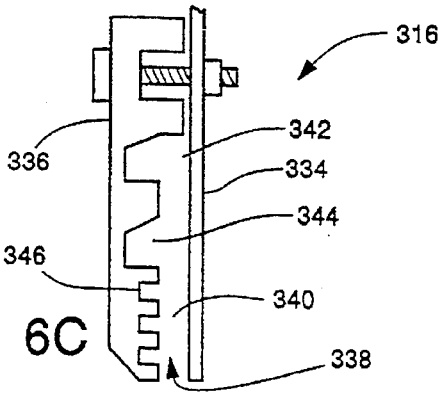
FIG. 6C illustrates a mount for use with the flap or seal illustrated in FIGS. 6A and 6B.

With reference to FIGS. 6A–6C, a flap 314 that can be slidably mounted and demounted from the sweeper 20 and that employs a plurality of wear indicators is discussed. Additionally, a flap mounting structure 316 that permits the flap 314 to be slidably mounted and demounted as well as permits the position of the flap 314 relative to the surface 52 to be adjusted is discussed. The flap 314 extends longitudinally from a first terminal 318 to a second terminal end 320 and extends vertically from a lower terminal edge 322 to an upper terminal edge 324. Further, the flap 314 includes a lower edge surface 326 and an upper edge surface 328 that is thicker than the lower edge surface 326. Additionally, the flap 314 includes a first wear indicator 330 for use in determining when the position of the flap 314 should be adjusted and a second wear indicator 332 for use in determining when the flap 314 should be replaced.

The flap mounting structure 316 includes a first portion 334 and a second portion 336 that cooperates with the first portion 334 to form a slot 338 that permits sliding engagement of the flap 314 as well as adjustment of the position of the flap 314 relative to the surface 52. The slot 338 includes a lower slot portion 340 for accommodating at least a portion of the lower edge surface 326 of the flap 314, a first upper slot portion 342 for accommodating the upper edge surface 328 of the flap 314 when the flap 314 is initially mounted to the sweeper 20, and a second upper slot portion 344 for slidably receiving the upper edge surface 328 of the flap 314 after the first wear indicator 330 has indicated that the flap 314 needs to be lowered to bring the lower terminal edge 322 close to the surface 52. The slot 338 further includes grooves 346 for, as previously discussed, facilitating the sliding engagement between the flap 314 and the slot 338.

In use, the flap 314 is initially, slidably inserted into the slot 338 such that the upper edge surface 328 of the flap 314 is disposed in the first upper slot portion 342 of the slot 338. When an operator determines, by inspection of the first wear indicator 330, that the position of the flap 314 requires adjustment so that the lower terminal edge is disposed closer to the surface 52, the flap 314 is slidably removed from the slot 338. The flap 314 is then reinserted into the slot 338 such that the upper edge surface 328 of the flap 314 is now received in the second upper slot portion 344 of the slot 338, thereby disposing the lower terminal edge 322 of the flap 314 closer to the surface 52. When an operator determines that the lower terminal edge 322 of the flap 314 is approaching the second wear indicator 332 or has gone past the second wear indicator 332, the flap 314 is slidably removed from the slot 338 and discarded. A new flap 314 can then be inserted in the slot 338 and the aforementioned process repeated.

Figures 7A, 7B:
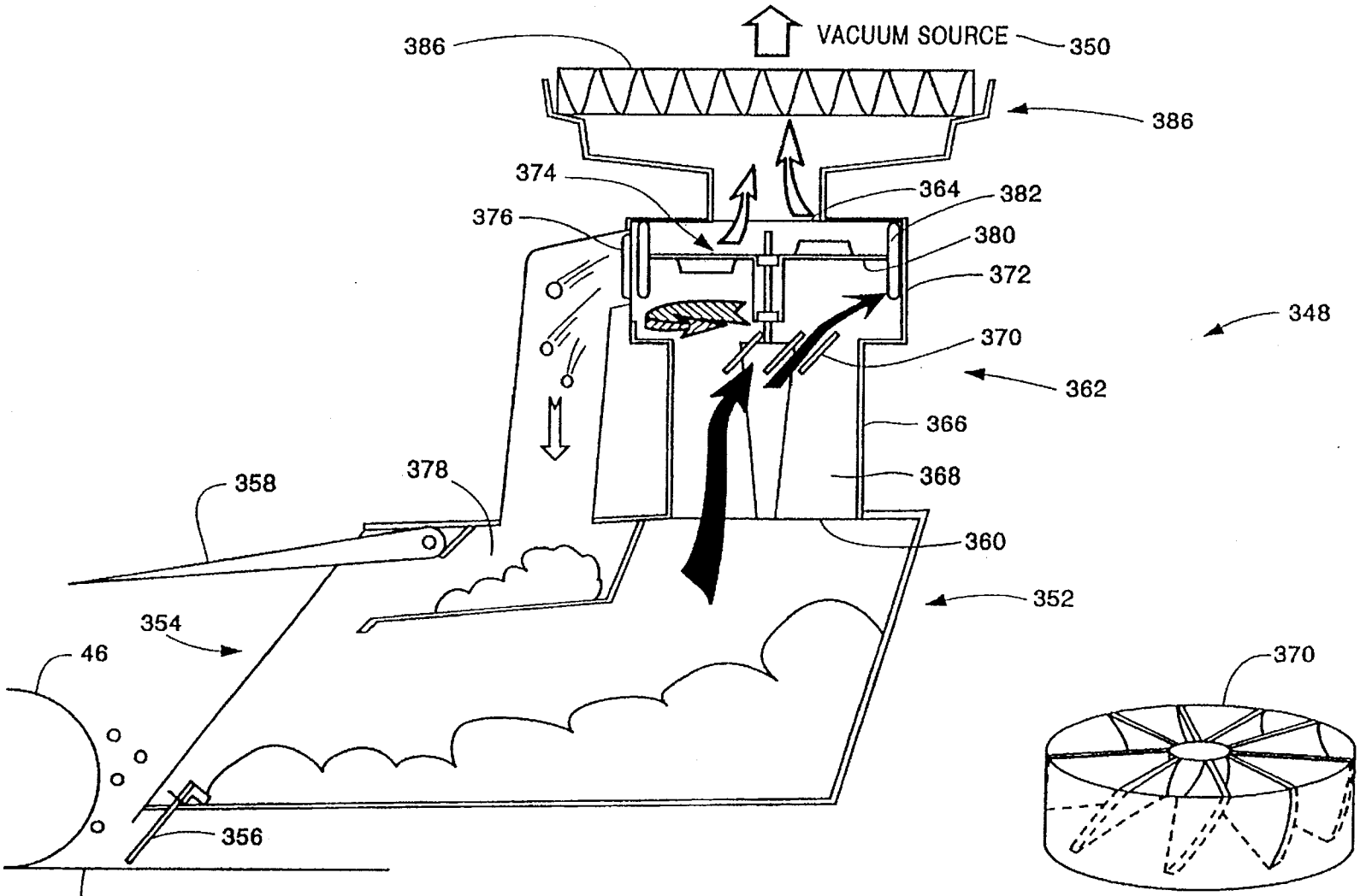
FIG. 7A is a cross-sectional diagram of the hopper, pre-filter and filter employed in the sweeper shown in FIG. 1A.
FIG. 7B is a detailed free body diagram of the vane structure portion of the pre-filter.

With reference to FIGS. 7A and 7B, a vacuum system 348 that reduces the need to clean a filter within the system, especially when used in applications in which relatively fine particle matter must be swept up from a floor surface, is described. The system 348 includes the first cylindrical broom 46 that is used to lift debris from the surface 52 so that the debris can become entrained in a directional airstream created by a vacuum source 350. The vacuum system 348 also includes a first hopper 352 for receiving the debris lifted by the first cylindrical broom 46 and entrained in the airstream produced by the vacuum source 350 via a hopper entrance port 354 defined by a flap 356 and a rotatable door 358, precipitating heavier debris out of the airstream, and then passing the airstream through a hopper exit port 360.

The vacuum system 348 further includes a pre-filter 362 for receiving the airstream provided at the hopper exit port 360, precipitating out less heavier debris than was precipitated out by the first hopper 352, and passing the airstream on through a pre-filter exit port 364. The pre-filter 362 includes a first chamber 366 that houses a toroidal-shaped conduit 368 and a vaned structure 370 that cooperates with the conduit 368 to create a vortex in a second chamber 372. Located within the second chamber 372 is a rotatable wheel 374 for directing debris in the vortex established by the toroidally-shaped conduit 368 and vaned structure 370 out an exit port 376 that communicates with a second hopper 378. The rotatable wheel 374 includes vaned arms 380 that, in response to the passing airstream, cause the rotatable wheel 374 to turn. Located on the ends of the vaned arms 380 are cups 382 that, upon rotation of the rotatable wheel 374, engage debris in the airstream and direct the debris out the exit port 376 and into the hopper 378.

The vacuum system 348 further includes a filter 384 for receiving the airstream provided at the pre-filter exit port 364, precipitating debris out of the airstream that is generally lighter than the debris precipitated out by the first hopper 352 and the pre-filter 362, and passing the resulting and relatively clean airstream on through to the vacuum source 350. The filter 384 is preferably a pleated panel filter although other types of filters are also feasible.

Figure 8A:
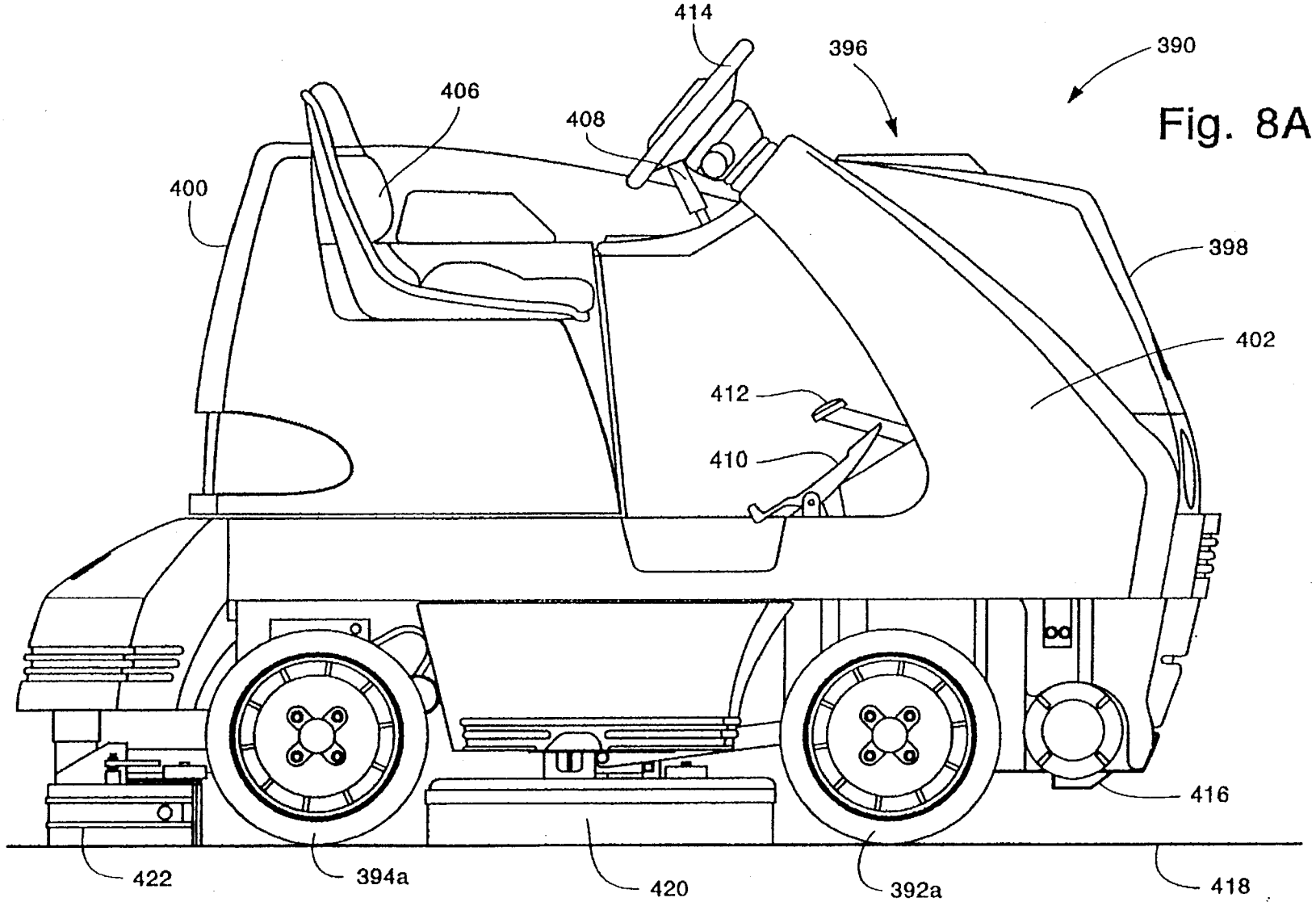
FIG. 8A is a right side view of a four-wheel scrubber that embodies a number of the inventions disclosed herein.
Figure 8B:
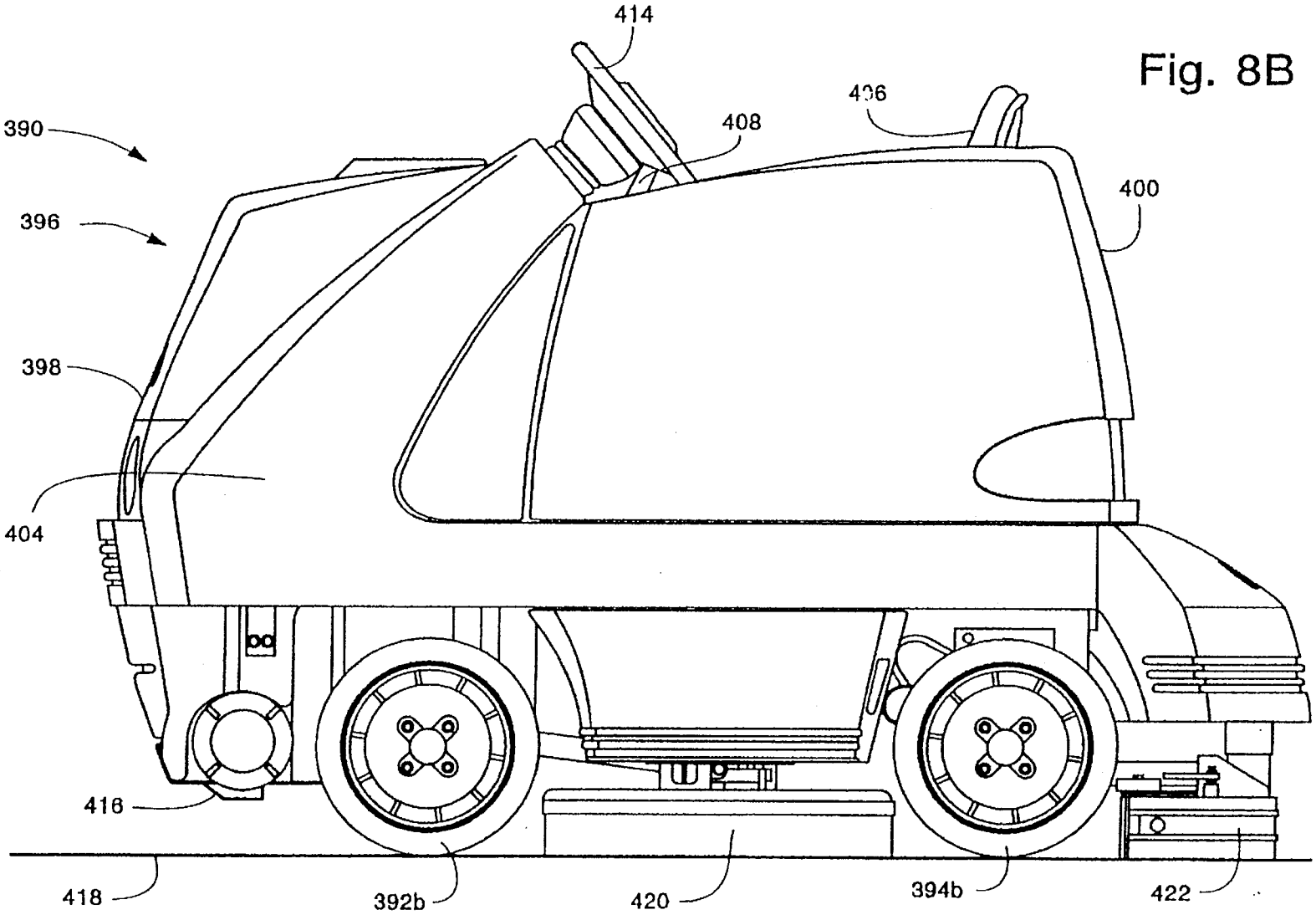
FIG. 8B is a left side view of the four-wheel scrubber illustrated in FIG. 8A.

Operation of the vacuum system 348 commences with the opening of the rotatable door 358 and the establishment of the directional airstream by the vacuum source 350. Next, the first cylindrical broom is activated to lift debris from the surface 52. The debris becomes entrained in the airstream established by the vacuum source and enters the first hopper 352 through the hopper entrance port 354. The first hopper 352 precipitates out the heavier debris entrained in the airstream and directs the airstream to the hopper exit port 360. The pre-filter 362 then receives the airstream provided at the hopper exit port 360. The toroidally-shaped conduit 360 and the vane structure.370 of the pre-filter 362 then establish a vortex in the second chamber 372 that directs the debris in the airstream towards the outer edge of the second chamber 372. In addition, the passage of the airstream through the second chamber 372 of the pre-filter 362 causes the rotatable wheel 374 to begin rotating. Rotation of the wheel 374 permits the cups 382 to direct the debris in the airstream that has been thrown toward the outside of the second chamber 372 to be directed to the exit port 376 and into the second hopper 378. The pre-filter then directs the airstream to the pre-filter exit port 384. The filter 386 then receives the airstream provided at the pre-filter exit port 384, filters out the debris in the airstream that is generally lighter than the debris removed from the airstream by the first hopper 352 and the pre-filter 362, and then passes the airstream on through the filter exit port 388. FIGS. 8A and 8B illustrate an industrial scrubber 390 for scrubbing floors that embodies a number of the inventions disclosed hereinafter. Generally the scrubber 390 includes two front, steerable wheels 392A, 392B and two rear, non-steerable wheels 394A, 394B that are operably connected to a frame (not shown). The scrubber 390 further includes a body 396 that has a front side 398, a rear side 400, a right side 402, and a left side 404. Also included as part of the scrubber 390 is an operator's seat 406 from which an operator can actuate a gearshift lever 408, an accelerator 410, a brake pedal 412, and a steering wheel 414 as well as other controls. A nozzle or spray system 416 is provided for spraying a cleaning solution on a surface 418 that is to be cleaned by the scrubber 390. The scrubber 390 further includes a scrubbing device 420 for scrubbing the cleaning solution into the surface 418 to effect removal of dirt from the surface 418. A primary squeegee 422 removes at least a portion of the wastewater produced by the action of the scrubbing device 420. A secondary or pre-squeegee (not shown) that is located between the two rear, non-steerable wheels 394A, 394B and the scrubbing device 420 removes at least a portion of the wastewater produced by the scrubbing device 420 as described hereinafter. In general, operation of the scrubber 390 commences with the nozzle or spray system 416 applying a cleaning solution to the surface 418. As the scrubber 390 progresses forward, the scrubbing device 420 scrubs the cleaning solution into the surface 418 to remove dirt and other grime from the surface 428 that becomes entrained in a wastewater stream. The primary squeegee 422 and the secondary squeegee then remove the wastewater stream from the surface 418.

Figure 9A:
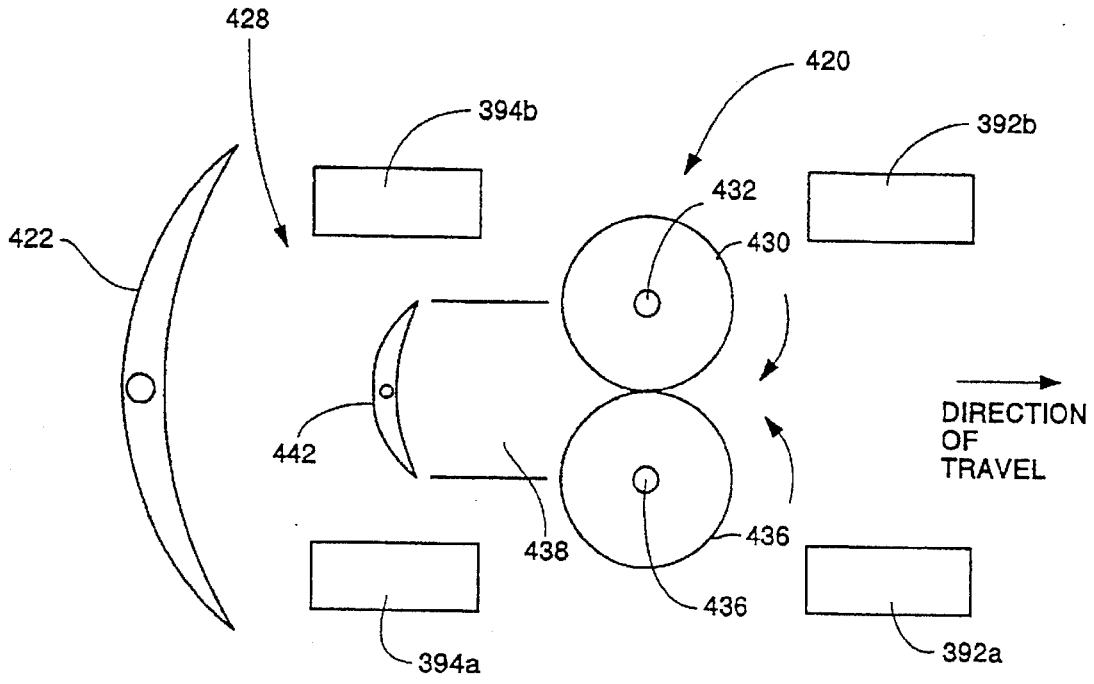
FIG. 9A is a free body diagram that illustrates the relationship between the wheels, the counter rotating disk brushes, primary squeegee, and secondary or pre-squeegee of the scrubber illustrated in FIGS. 8A and 8B.
Figure 9B:
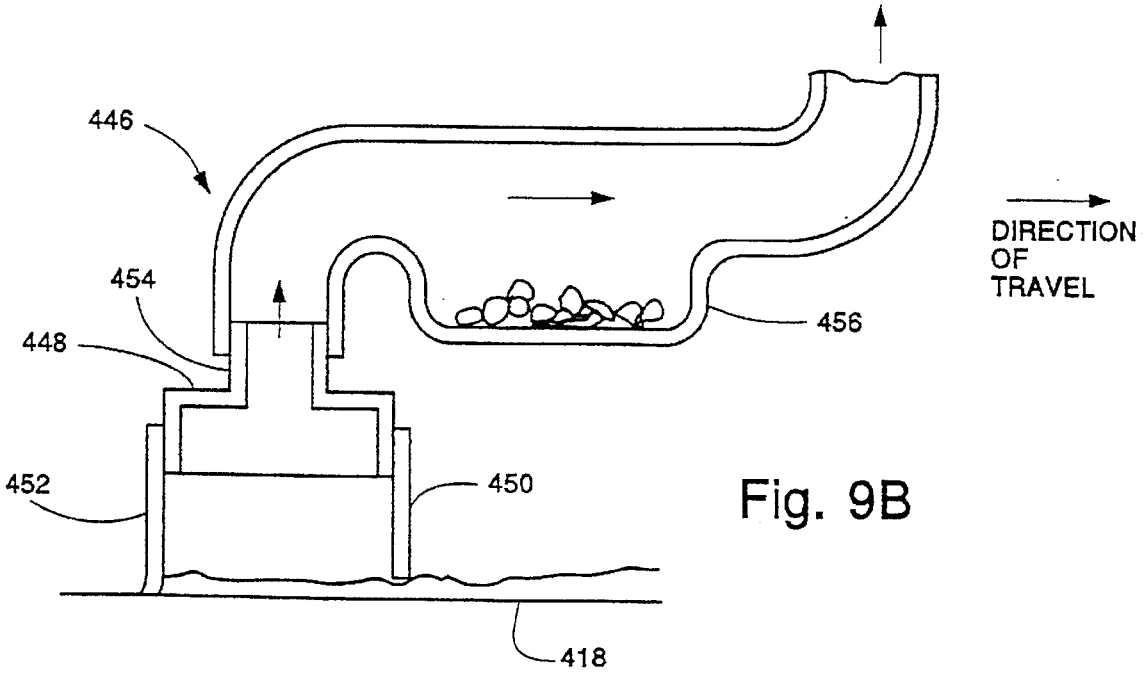
FIG. 9B is a cross-sectional diagram of an embodiment of the pre-squeegee illustrated in FIG. 9A that includes a trap for collecting solid or large debris.
Figure 9C:
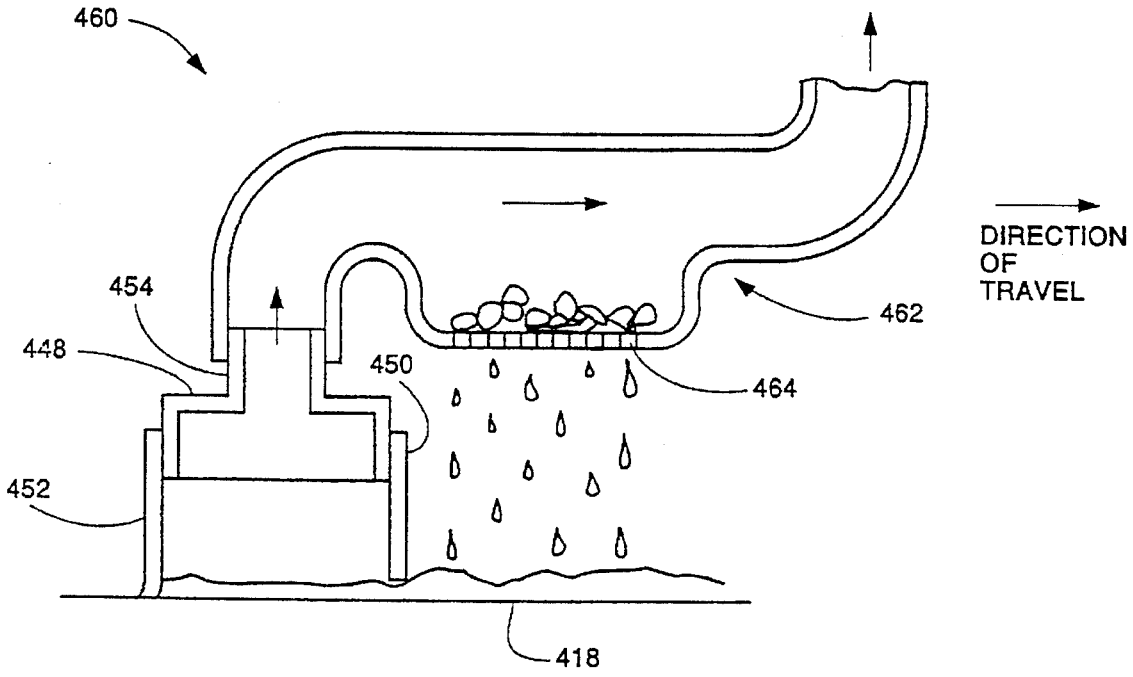
FIG. 9C is a cross-sectional diagram of an embodiment of the pre-squeegee illustrated in FIG. 9A that includes a trap for collecting solid or large debris and a drain for permitting wastewater to exit the trap.

With reference to FIGS. 9A–9C, a scrubbing/vacuum squeegee system 428 is described that addresses the problems related to the heavier concentration of wastewater produced in the area between two counter rotating disk scrub brushes. The scrubbing/vacuum squeegee system 428 includes a first disk brush that rotates about a first axis 432 and scrubs the cleaning solution provided by the spray system 416 into the surface 418 to remove dirt and grime from the surface and entrain the dirt and grime in a wastewater stream. A second disk brush 434 that rotates in a counter clockwise direction about a second axis 436 provides the same scrubbing function as the first disk brush 430. The first disk brush 430 and the second disk brush 434 are located substantially adjacent to one another. Briefly, as the scrubber 390 moves forward, the first disk brush 430 and second disk brush 434 scrub the surface 418 with the cleaning solution provided by the spray system 416 and, as a result, produce a stream of wastewater. Due to the location of the first disk brush 430 adjacent to the second disk brush 434, the clockwise rotation of the first disk brush 430, and the counter clockwise rotation of the second disk brush 434, there is a heavier concentration of wastewater produced in an area 438 located behind the first disk brush 430 and the second disk brush 434 and substantially between the first axis 432 of the first disk brush 430 and the second axis 436 of the second disk brush 434 than in the areas to the sides of the first and second disk brushes 430, 434.

To collect the wastewater produced by the first disk brush 430 and the second disk brush 434, the scrubbing/vacuum system 428 includes the primary squeegee 422, which is responsible for removing the bulk of the wastewater produced by the first disk brush 430 and second disk brush 434. The primary squeegee 422 is located behind the two rear, non-steerable wheels 394A, 394B and has a length that is substantially equal to, if not slightly greater than, the distance between the two rear, non-steerable wheels 394A, 394B.

The squeegee system 440 further includes a secondary or pre-squeegee 442 that is responsible for processing a portion of the heavier concentration of wastewater produced in the area 438. The secondary squeegee 442 is located between the primary squeegee 422 and the first and second disk brushes 430, 434. The length of the secondary or pre-squeegee 442 is substantially equal to, if not slightly greater than, the distance between the first axis 432 of the first disk brush 430 and the second axis 436 of the second disk brush 434.

Operation of the scrubbing/vacuum system 428 begins with the spray system 416 applying a cleaning solution to the surface 418 and the operator initiating both forward movement of the scrubber 390 and rotation of the first and second disk brushes 430, 434. As previously mentioned, the first and second disk brushes 430, 434 scrub the cleaning solution into the surface 418 to remove dirt and grime therefrom and produce a stream of wastewater in which the dirt and grime is entrained. At least a portion of the heavier concentration of wastewater produced in the area 438 behind the first and second disk brushes 430, 434 is removed by the secondary squeegee 442. Subsequently, the primary squeegee 422 removes a substantial portion of the wastewater produced outside of the area 438 as well as a substantial portion of any wastewater produced in the area 438 that is not removed by the secondary squeegee 442, thereby providing efficient removal of wastewater from the surface 418.

With reference to FIG. 9B, a secondary squeegee with trap 446 (an embodiment of the secondary squeegee 442) that is capable of trapping or removing solid or large debris from the surface 418 to reduce streaking by the primary squeegee 422 is discussed. The secondary squeegee with trap 446 includes as squeegee mount 448 on which are mounted a front squeegee rubber 450 and a rear squeegee rubber 452. The squeegee mount 448 also includes an exit port 454 that is operatively connected to a trap 456 which is in communication with a vacuum source (not shown).

Operation of the secondary squeegee with trap 446 commences when wastewater passes under the lower edge of the front squeegee rubber and is trapped in the area between the front squeegee rubber 450 and rear squeegee rubber 452. The vacuum source then pulls the wastewater and any solid or large debris contained therein up through the exit port 454 and into the trap 456 where the heavier debris can precipitate out of the vacuum stream. Consequently, the secondary squeegee with trap 446 removes debris that could cause the primary squeegee 442 to streak.

With reference to FIG. 9C, a secondary squeegee with trap and drain 460 that removes debris from the surface 418 that might cause the primary squeegee 422 to streak while also relieving the load on the vacuum source when a very heavy concentration of wastewater, debris or a combination thereof is encountered is discussed. The secondary vacuum squeegee with trap and drain 460 includes a squeegee mount, front squeegee rubber, and rear squeegee rubber that are identical to those employed in the secondary squeegee with trap 446 shown in FIG. 9B. As a consequence, these portions of the secondary squeegee rubber with trap and drain 460 bear the same reference numbers as the corresponding parts for the secondary squeegee with trap 446 shown in FIG. 9B. In contrast, however, the secondary squeegee with trap and drain 460 includes a trap conduit 462 for trapping solid or large debris that includes drain holes 464 for permitting wastewater to return to the surface 418 and thereby relieve the load on the vacuum source during the noted conditions.

Operation of the secondary squeegee with trap and drain 460 is substantially identical to the operation of the secondary squeegee with trap discussed in reference to FIG. 9B. However, the secondary squeegee with trap and drain 460 permits wastewater that cannot be handled by the vacuum source to return to the surface 418 so that if the load on the vacuum source is reduced, the wastewater so returned to the surface 418 can be removed by the secondary squeegee 460.

With Reference to FIGS. 10A–10I, a squeegee rubber 468 and squeegee mount system 470 are discussed that facilitate mounting of the squeegee rubber to a squeegee mount and permit the squeegee rubber to extend past the ends of a squeegee mount so that the squeegee rubber can be used against walls and the like.

Figure 10E:
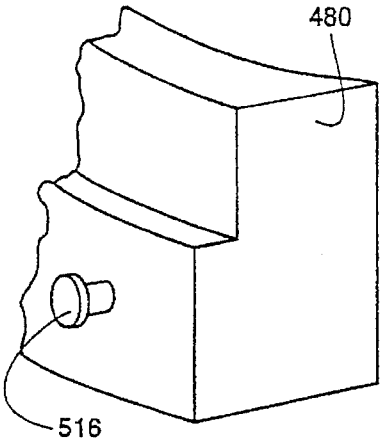
FIG. 10E is a detailed view of the end of the squeegee mount shown in FIG. 10A that includes a buttonhead for mounting of the rear squeegee rubber illustrated in FIG. 10C and a retaining strap.
Figure 10I:
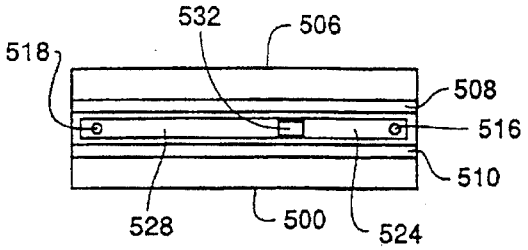
FIG. 10I is a rear view showing the rear squeegee rubber retained against the squeegee mount and the over-center latch used to connect the two restraining straps.
Figure 10F:
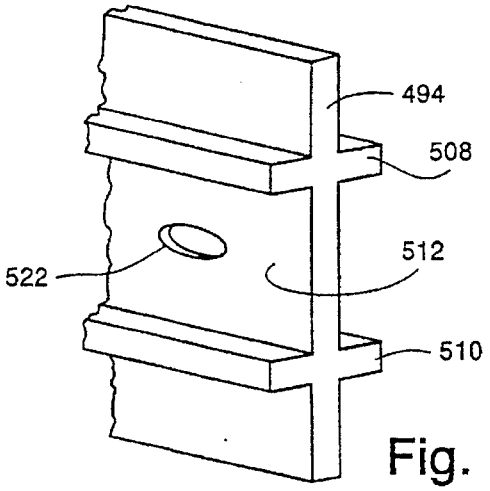
FIG. 10F is a detailed view of the end of the rear squeegee rubber illustrated in FIG. 10C that includes a hole for positioning over the buttonhead structure illustrated in FIG. 10E.
Figure 10H:
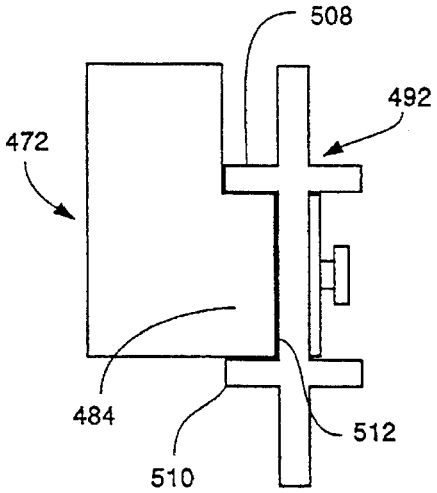
FIG. 10H is an end view of the mount shown in FIG. 10A with the rear squeegee rubber shown in FIG. 10C and strap illustrated in FIG. 10G attached thereto.
Figure 10G:
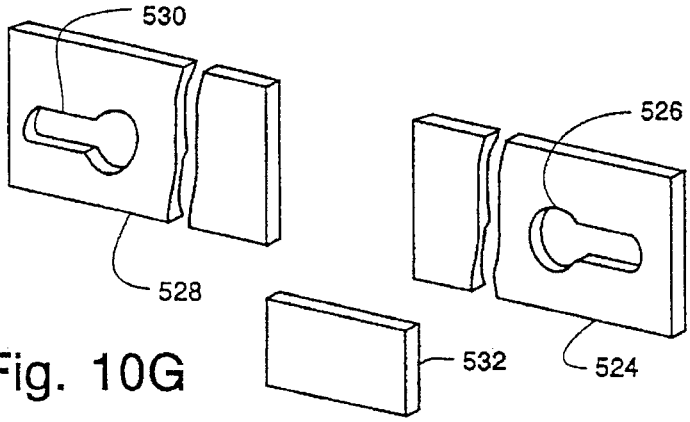
FIG. 10G is a detailed end view of a strap for retaining the rear squeegee rubber shown in FIG. 10C against the mount in FIG. 10A that includes a keyhole for receiving the buttonhead structure illustrated in FIG. 10E.
Figure 10A:
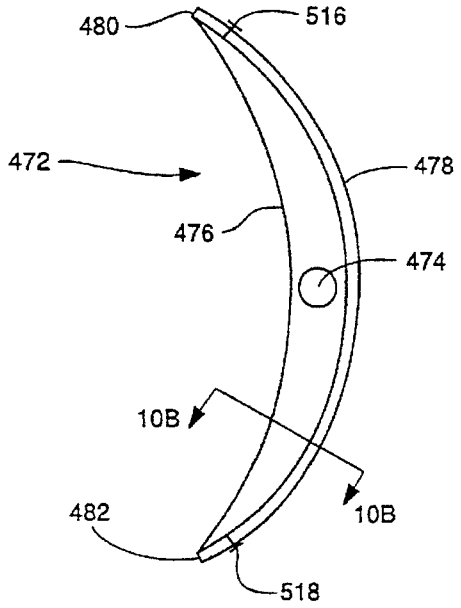
FIG. 10A is a top view of a squeegee mount.
Figure 10C:
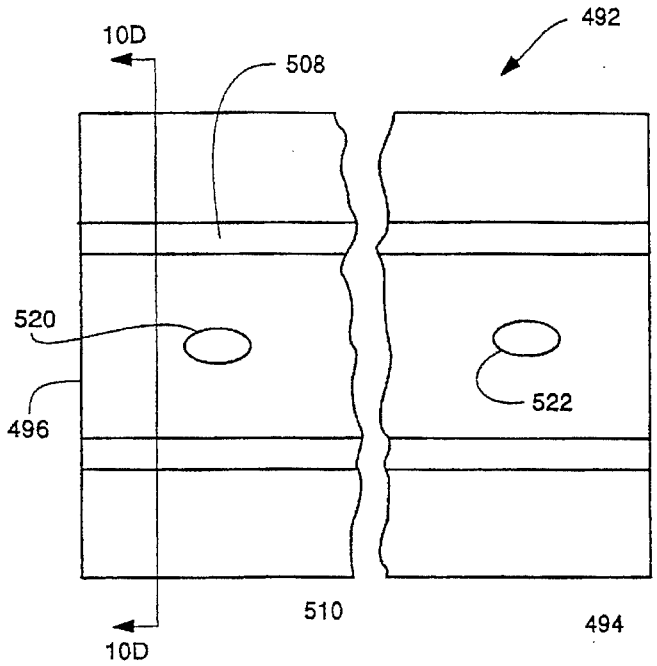
FIG. 10C is a side view of a rear squeegee rubber for mounting on the squeegee mount shown in FIG. 10A.
Figure 10B:
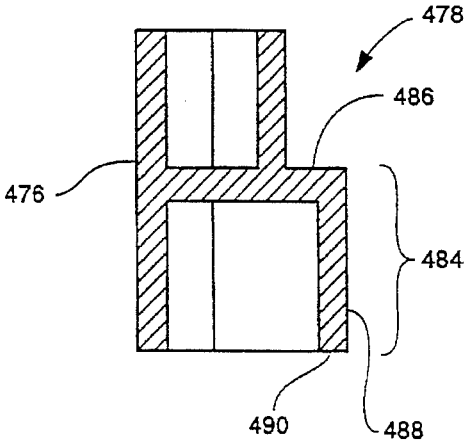
FIG. 10B is a cross-sectional view of the squeegee mount illustrated in FIG. 10A.

With reference to FIGS. 10A and 10B, the squeegee rubber mount system 470 includes a squeegee rubber mount 472 that has a port 474 for connection to a vacuum source, a front surface 476 for receiving a front squeegee rubber (not shown), and a rear, stepped surface 478 for receiving a rear squeegee rubber. The rear, stepped surface 478 extends from a first terminal end 480 to a second terminal end 482. The rear, stepped surface 478 further includes a crown 484 formed by a upper horizontal surface 486, vertical surface 488, and lower horizontal surface 490.

Figure 10D:
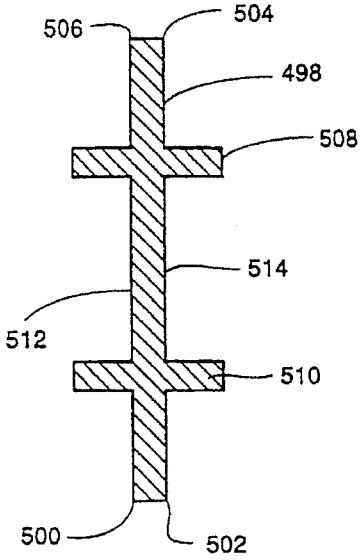
FIG. 10D is a cross-section of the rear squeegee rubber illustrated in FIG. 10C.

With reference to FIGS. 10C–10D, a rear squeegee rubber 492 that mounts on the rear, stepped surface 478 of the squeegee rubber mount 472 in a manner than prevents vertical displacement therebetween and further allows a number of different edges to be disposed adjacent to the surface 418 is discussed. The rear squeegee rubber extends from a first end 494 to a second end 496. Further, the rear squeegee rubber 492 includes a vertical member 498 with a first corner edge 500, second corner edge 502, third corner edge 504, and forth corner edge 506. Additionally, the rear squeegee rubber 492 includes a first horizontal member 508 and a second horizontal member 510 that define a first slot 512 and a second slot 514, each of which is capable of accommodating the crown 484.

With reference to FIGS. 10H, which illustrates the rear squeegee rubber 492 operatively connected to the squeegee rubber mount 472, the crown 484 and the first and second horizontal members 508,510 of the rear squeegee rubber, which define slot 512, cooperate with one another to prevent vertical displacement of the rear squeegee rubber 492 relative to the squeegee rubber mount 472. It should also be appreciated however, that the squeegee rubber mount could employ a slot and the squeegee rubber a cooperating crown that would achieve the same effect. Further, with continuing reference to FIG. 10H, it should be appreciated that, with the illustrated orientation of the rear squeegee rubber 492 to the squeegee rubber mount 472, the first corner edge 500 will be in contact with the surface 418 and will eventually become worn. At this point, the rear squeegee rubber 492 can be dismounted from the squeegee rubber mount 472 and the first end 494 and second end 496 swapped so that the second corner edge 502 will now ride against the surface 418. Once the second corner edge 502 is worn, the rear squeegee rubber 492 can be dismounted and turned over so that the third corner edge 504 or the fourth corner edge 506 can then be disposed adjacent to the surface 418.

With reference to FIGS. 10E–10G, further features of the squeegee rubber 468 and squeegee rubber mount system 470 that facilitate mounting of the squeegee rubber 468 as well as permit the squeegee rubber 468 to extend beyond the ends of the squeegee rubber mount 472 are discussed. Specifically, with reference to FIGS. 10A and 10E, the squeegee rubber mount 472 includes a first buttonhead pin 516 and a second buttonhead pin 518. With reference to FIGS. 10C and 10F, the rear squeegee rubber 492 includes a first hole 520 for receiving one of the first buttonhead pin 516 and the second buttonhead pin 518 and a second hole for receiving the other of the first buttonhead pin 516 and the second buttonhead pin 518, depending upon the orientation of the rear squeegee rubber 492 to the squeegee rubber mount 472. The squeegee rubber mount system 470 further includes a first strap 524 with a first key hole 526 for receiving one of the first buttonhead pin 516 and the second buttonhead pin 518. The squeegee rubber mount system 470 further includes a second strap 528 with a second keyhole 530 for receiving the other of the first buttonhead pin 516 and the second buttonhead pin 518. Lastly, the squeegee rubber mount system includes an over center latch 532 for engaging the ends of the first strap 524 and the second strap 528 to clamp the rear squeegee rubber 492 to the squeegee rubber mount 472.

With reference to FIGS. 10H and 10I, the mounting of the rear squeegee rubber 492 to the squeegee rubber mount 472 is further discussed. Specifically, mounting of the rear squeegee rubber 492 to the squeegee rubber mount 472 commences with the first buttonhead pin 516 being disposed through one of the first hole 520 and the second hold 522 and the second buttonhead pin 518 being disposed through the other of the first hole 520 and the second hole 522. This serves to hold the rear squeegee rubber 492 in place relative to the squeegee 472 while the first strap 524 and the second strap 528 and the over center latch 532 are positioned to clamp the rear squeegee rubber 492 against the squeegee rubber mount 472. With the rear squeegee rubber 492 thusly held in place against the squeegee rubber mount 472, the first buttonhead pin 516 is disposed through the first keyhole 526 of the first strap 524 and the second buttonhead pin 518 is disposed through the second keyhole 520 of the second strap 528. The over center latch 532 then engages the free ends of the first and second straps and is actuated to clamp the rear squeegee rubber 492 against the squeegee rubber mount 472. Since the ends of the first strap 524 and the second strap 528 do not extend beyond the first and second terminal ends 480, 482 of the squeegee rubber mount 472, the squeegee rubber 468 can extend past the ends of the mount and, advantageously, be used against walls and the like.

The foregoing description of the invention has been presented for purposes of illustration and description. Further, the description is not intended to limit the inventions to the form disclosed herein. Consequently, variations and modifications commensurate with the above teachings, and the skill or knowledge in the relevant art are within the scope of the present invention. The preferred embodiments described hereinabove are further intended to explain the best mode known of practicing the inventions and to enable others skilled in the art to utilize the inventions in various embodiments and with the various modifications required by their particular applications or uses of the invention. It is intended that the appended claims be construed to include alternate embodiments to the extent permitted by the prior art.

What is claimed is:

1. An apparatus for cleaning a surface comprising: a frame;

means, operatively attached to said frame, for cleaning a surface;

at least three wheels for moving said frame and said means for cleaning over a surface; and means for steering at least one of said at least three wheels;

wherein said means for cleaning includes a squeegee mount that has a first squeegee mount end, a second squeegee mount end, a squeegee mount top edge, a squeegee mount bottom edge, a squeegee mount side surface that extends from said first squeegee mount end to said second squeegee mount end and from said squeegee mount top edge to said squeegee mount bottom edge;

a squeegee rubber that includes a first squeegee rubber end, a second squeegee rubber end, a squeegee rubber top edge, a squeegee rubber bottom edge, a first squeegee rubber side surface that extends from said first squeegee rubber end to said second squeegee rubber end and from said squeegee rubber top edge to said squeegee rubber bottom edge, and a second squeegee rubber side surface that extends from said first squeegee rubber end to said second squeegee rubber end and from said squeegee rubber top edge to said squeegee rubber bottom edge;

wherein one of said squeegee mount side surface and said first squeegee rubber side surface includes a crown and the other of said squeegee mount side surface and said first squeegee rubber side surface includes a first longitudinally extending slot dimensioned to fit over said crown and thereby prevent vertical displacement between said squeegee mount and said squeegee rubber wherein said first longitudinally extending slot is capable of being entirely placed into contact with said squeegee mount at the same time.

2. An apparatus, as claimed in claim 1, wherein:

when said squeegee mount side surface includes said crown and said first squeegee rubber side surface includes said first longitudinally extending slot, said second squeegee rubber side surface includes a second longitudinally extending slot that permits said squeegee rubber to be mounted to said squeegee mount side surface so that different portions of at least one of said squeegee rubber top edge and said squeegee rubber bottom edge can be positioned adjacent to the surface to be cleaned.

3. An apparatus, as claimed in claim 1, wherein:

when said first squeegee rubber side surface includes said crown and said squeegee mount side surface includes said first longitudinally extending slot, said second squeegee rubber side surface includes a second longitudinally extending crown that permits portions of at least one of said squeegee rubber top edge and said squeegee rubber bottom edge to be positioned adjacent to the surface to be cleaned.

4. An apparatus, as claimed in claim 1, wherein:

said squeegee mount includes a first buttonhead located on said squeegee mount side surface and adjacent to said first squeegee mount end and a second buttonhead located on said first squeegee mount side surface and adjacent to said second squeegee mount end;

said squeegee rubber includes a first squeegee rubber slot for engaging said first buttonhead and a second squeegee rubber slot for engaging said second buttonhead.

5. An apparatus, as claimed in claim 4, further comprising:

a fastening device for holding said squeegee rubber against said squeegee mount, said squeegee fastening device includes a first squeegee strap with a first squeegee strap slot for engaging said first buttonhead, a second squeegee strap with a second squeegee strap slot for engaging said second buttonhead, and means for clamping said first squeegee strap to said second squeegee strap to hold said squeegee rubber between said first and second squeegee straps and said squeegee mount.

6. An apparatus, as claimed in claim 1, wherein:

said squeegee rubber has a squeegee rubber length that extends from said first squeegee rubber end to said second squeegee rubber end and is greater than a squeegee mount length that extends from said first squeegee mount end to said squeegee mount end.

7. An apparatus, as claimed in claim 1 wherein:

said means for cleaning includes a flexible, substantially planar member that includes a first terminal edge and a second terminal edge, wherein when said flexible, substantially planar member is in use, said first terminal edge contacts said surface and said second terminal edge is operatively connected to said frame and separated from said surface;

wherein said flexible, substantially member includes a wear indicator located between said first and second terminal edges and, prior to any wear of said first terminal edge, separated from said first terminal edge.

8. An apparatus for cleaning a surface comprising:

a frame;

means, operatively attached to said frame, for cleaning a surface;

at least three wheels for moving said frame and said means for cleaning over a surface; and means for steering at least one of said at least three wheels;

wherein said means for cleaning includes a squeegee mount that has a first squeegee mount end, a second squeegee mount end, a squeegee mount top edge, a squeegee mount bottom edge, a squeegee mount side surface that extends from said first squeegee mount end to said second squeegee mount end and from said squeegee mount top edge to said squeegee mount bottom edge;

a squeegee rubber that includes a first squeegee rubber end, a second squeegee rubber end, a squeegee rubber top edge, a squeegee rubber bottom edge, a first squeegee rubber side surface that extends from said first squeegee rubber end to said second squeegee rubber end and from said squeegee rubber top edge to said squeegee rubber bottom edge, and a second squeegee rubber side surface that extends from said first squeegee rubber end to said second squeegee rubber end and from said squeegee rubber top edge to said squeegee rubber bottom edge;

wherein said squeegee mount includes a first buttonhead located on said squeegee mount side surface and adjacent to said first squeegee mount end and a second buttonhead located on said first squeegee mount side surface and adjacent to said second squeegee mount end;

said squeegee rubber includes a first squeegee rubber slot for engaging said first buttonhead and a second squeegee rubber slot for engaging said second buttonhead;

a fastening device for holding said squeegee rubber against said squeegee mount, said squeegee fastening device includes a first squeegee strap with a first squeegee strap slot for engaging first buttonhead, a second squeegee strap with a second squeegee strap slot for engaging said second buttonhead, and means for clamping said first squeegee strap to said second squeegee strap to hold said squeegee rubber between said first and second squeegee straps and said squeegee mount.

9. An apparatus, as claimed in claim 8, wherein:

said squeegee rubber has a squeegee rubber length that extends from said first squeegee rubber end to said second squeegee rubber end and is greater than a squeegee mount length that extends from said first squeegee mount end to said squeegee mount end.

10. An apparatus for cleaning a surface comprising:

a frame;

means, operatively attached to said frame, for cleaning a surface;

at least three wheels for moving said frame and said means for cleaning over a surface; and means for steering at least one of said at least three wheels;

wherein said means for cleaning includes a squeegee mount that has a first squeegee mount end, a second squeegee mount end, a squeegee mount top edge, a squeegee mount bottom edge, a squeegee mount side surface that extends from said first squeegee mount end to said second squeegee mount end and from said squeegee mount top edge to said squeegee mount bottom edge;

a squeegee rubber that includes a first squeegee rubber end, a second squeegee rubber end, a squeegee rubber top edge, a squeegee rubber bottom edge, a first squeegee rubber side surface that extends from said first squeegee rubber end to said second squeegee rubber end and from said squeegee rubber top edge to said squeegee rubber bottom edge, and a second squeegee rubber side surface that extends from said first squeegee rubber end to said second squeegee rubber end and from said squeegee rubber top edge to said squeegee rubber bottom edge;

wherein one of said squeegee mount side surface and said first squeegee rubber side surface includes a crown and the other of said squeegee mount side surface and said first squeegee rubber side surface includes a first longitudinally extending slot dimensioned to fit over said crown and thereby prevent vertical displacement between said squeegee mount and said squeegee rubber; and wherein said squeegee mount includes a first buttonhead located on said squeegee mount side surface and adjacent to said first squeegee mount end and a second buttonhead located on said first squeegee mount side surface and adjacent to said second squeegee mount end;

said squeegee rubber includes a first squeegee rubber slot for engaging said first buttonhead and a second squeegee rubber slot for engaging said second buttonhead.

11. A squeegee for use with a squeegee mount, the squeegee comprising:

a vertical member having a first lateral side, a second lateral side, a lower end with a first corner edge and a second corner edge; and means for engaging the squeegee mount;

wherein said means for engaging includes a first engaging portion that laterally extends from said first lateral side and is capable of being entirely placed into contact with the squeegee mount at the same time;

wherein said first engaging portion includes a first arm extending from said first lateral side of said vertical member to a first arm terminal end and a second arm extending from said first lateral side of said vertical member to a second arm terminal end;

wherein said first arm terminal end and said second arm terminal and define a first opening for a first recess that is capable of receiving the squeegee mount;

wherein said first opening has a vertical dimension that is at least substantially equal to the maximum vertical dimension of the squeegee mount;

wherein, when said first recess is disposed over squeegee mount, said first corner edge is operatively positioned for squeegeeing a surface.

12. A squeegee as claimed in claim 11, wherein said vertical member comprises:

an upper end with a third corner edge and a fourth corner edge;

wherein, when said first recess is disposed over the squeegee mount to operatively position said first corner edge for squeegeeing a surface and said first corner edge wears out, said first engaging portion can be disengaged from the squeegee mount, the squeegee then inverted relative to the squeegee mount, and said first engaging portion reengaged to the squeegee mount so that said third corner edge is operatively positioned for squeegeeing a surface.

13. A squeegee as claimed in claim 11, wherein:

said means for engaging includes a second engaging portion that laterally extends from said second lateral side and is capable of being entirely placed into contact with the squeegee mount at the same time;

wherein said second engaging portion includes a third arm extending from said second lateral side of said vertical member to a third arm terminal end and a fourth arm extending from said second lateral side of said first vertical member to a forth arm terminal end;

wherein said third arm terminal end and said fourth arm terminal end define a second opening for a second recess that is capable of receiving the squeegee mount;

wherein said second opening has a vertical dimension that is at least substantially equal to the maximum vertical dimension of the squeegee mount surface;

said vertical member includes an upper end with a third corner edge and a fourth corner edge;

wherein, when said first recess is disposed over the squeege mount to operatively position said first corner edge for squeegeeing a surface and said first corner edge wears out, said first engaging portion can be disengaged from the squeegee mount and said second engaging portion can then be engaged to the squeegee mount to operatively position said second corner edge for squeegeeing a surface;

wherein, when either said first recess is disposed over the squeegee mount to operatively position said first corner edge for squeegeeing a surface and said first corner edge wears out or said second recess is disposed over the squeegee mount to operatively position said second corner edge for squeegeeing a surface and said second corner edge wears out, either said first engaging portion or second engaging portion can be disengaged from the squeegee mount, the squeegee then inverted relative to the squeegee mount, and either said first engaging portion or said second engaging portion reengaged to the squeegee mount so that either said third corner edge or said fourth corner edge is operatively positioned for squeegeeing a surface.

14. A squeegee, as claimed in claim 11, wherein;

said means for engaging includes a second engaging portion that laterally extends from said second lateral side and is capable of being entirely placed into contact with the squeegee mount at the same time;

wherein said second engaging portion includes a third arm extending from said second lateral side of said vertical member to a third arm terminal end and a fourth arm extending from said second lateral side of said vertical member to a fourth arm terminal end;

wherein said third arm terminal end and said fourth arm terminal end define a second opening for a second recess that is capable of receiving the squeegee mount;

wherein said second opening has a vertical dimension that is at least substantially equal to the maximum vertical dimension of the squeegee mount surface;

wherein, when said second recess is disposed over the squeegee mount, said second corner edge is operatively positioned for squeegeeing a surface.

15. A squeegee for use with a squeegee mount that includes a crowned surface for receiving the squeegee, the crowned surface having a maximum vertical dimension, the squeegee comprising:

a vertical member having a first lateral side, a second lateral side, a lower end with a first corner edge and a second corner edge, and an upper end with a third corner edge and a fourth corner edge;

a first arm extending from said first lateral side of said vertical member to a first arm terminal end;

a second arm extending from said first lateral side of said vertical member to a second arm terminal end;

a third arm extending from said second lateral side of said vertical member to a third arm terminal end;

a fourth arm extending from said second lateral side of said vertical member to a fourth arm terminal end;

wherein said first arm terminal end and said second arm terminal end define a first opening for receiving the crowned surface of the squeegee mount;

wherein said first opening has a vertical dimension which is at least substantially equal to the maximum vertical dimension of the crowned surface;

wherein said third arm terminal end and said fourth arm terminal end define a second opening for receiving the crowned surface of the squeegee mount;

wherein said second opening has a vertical dimension which is at least substantially equal to the maximum vertical dimension of the crowned surface;

wherein said squeegee can be mounted on said crowned surface so that each of said first corner edge, said second corner edge, said third corner edge, and said fourth corner edge can be operatively positioned for squeegeeing a surface.

16. An apparatus, as claimed in claim 1, wherein:

said longitudinally extending slot has a longitudinally extending opening that is capable of receiving said crown.

17. An apparatus, as claimed in claim 1, further comprising:

fastening means for holding said squeegee rubber against said squeegee mount, wherein said squeegee rubber is located between said squeegee mount and said fastening means.

18. An apparatus, as claimed in claim 17, wherein:

said fastening means includes a first strap, a second strap, and means for connecting said first strap to said second strap.

19. A squeegee for use with a squeegee mount, the squeegee comprising:

a vertical member having a first lateral side, a second lateral side, and a lower end with a first corner edge; and means for engaging the squeegee mount; and wherein said means for engaging includes a first engaging portion that laterally extends from said first lateral side;

wherein said first engaging portion includes a first arm extending from said first lateral side of said vertical member to a first arm terminal end and a second arm extending from said first lateral side of said vertical member to a second arm terminal end;

wherein said first arm terminal end and said second arm terminal end define a first opening for a first recess that is capable of receiving the squeegee mount;

wherein said first opening has a vertical dimension that is at least substantially equal to the maximum vertical dimension of the squeegee mount;

wherein, said first recess can be disposed over the squeegee mount to operatively position said first corner edge for squeegeeing a surface.

20. A squeegee as claimed in claim 19, wherein:

said vertical member includes an upper end with a third corner edge;

wherein, said first recess can be disposed over the squeegee mount to operatively position said third corner edge for squeegeeing a surface.

21. A squeegee, as claimed in claim 19, wherein:

said lower end of said vertical member includes a second corner edge; and said means for engaging includes a second engaging portion that laterally extends from said second lateral side;

wherein said second engaging portion includes a third arm extending from said second lateral side of said vertical member to a third arm terminal end and a fourth arm extending from said second lateral side of said vertical member to a fourth arm terminal end;

wherein said third arm terminal end and said fourth arm terminal end define a second opening for a second recess that is capable of receiving the squeegee mount;

wherein said second opening has a vertical dimension that is at least substantially equal to the maximum vertical dimension of the squeegee mount surface;

wherein, said second recess can be disposed over the squeegee mount to operatively position said second corner edge for squeegeeing a surface.

22. A squeegee as claimed in claim 19, wherein:

said vertical member includes an upper end with a third corner edge and a fourth corner edge; and said means for engaging includes a second engaging portion that laterally extends from said second lateral side;

wherein said second engaging portion includes a third arm extending from said second lateral side of said vertical member to a third arm terminal end and a fourth arm extending from said second lateral side of said vertical member to a fourth arm terminal end;

wherein said third arm terminal end and said fourth arm terminal end define a second opening for a second recess that is capable of receiving the squeegee mount;

wherein said second opening has a vertical dimension that is at least substantially equal to the maximum vertical dimension of the squeegee mount surface;

wherein, said first recess can be disposed over the squeegee mount to operatively position said third corner edge for squeegeeing a surface;

wherein, said second recess can be disposed over the squeegee mount to operatively position either said second corner edge or said fourth corner edge for squeegeeing a surface.

* * * * *